United States Patent [19]

Date et al.

[11] 4,352,158

[45] Sep. 28, 1982

[54] ENGINE FUEL SUPPLY CONTROLLING SYSTEM

[75] Inventors: Tasuku Date, Tokyo; Toshio Nomura, Niiza; Isao Kobayashi, Tokyo, all of Japan

[73] Assignee: Honda Giken Kogyo Kabushiki Kaisha, Tokyo, Japan

[21] Appl. No.: 134,811

[22] Filed: Mar. 28, 1980

[30] Foreign Application Priority Data

Apr. 2, 1979 [JP] Japan ..... 54-38394

[51] Int. Cl.[3] ..... F02M 51/00; F02D 5/02

[52] U.S. Cl. ..... 364/431.05; 123/486; 123/492; 123/493; 364/431.12

[58] Field of Search ..... 364/431, 117; 123/416, 123/480, 484, 486, 571, 574, 492, 493

[56] References Cited

U.S. PATENT DOCUMENTS

| | | | |
|---|---|---|---|
| 4,009,699 | 3/1977 | Hetzler et al. | 364/431 X |
| 4,034,722 | 7/1977 | Miyakawa | 123/486 |
| 4,048,965 | 9/1977 | Bianchi et al. | 123/486 |
| 4,142,493 | 3/1979 | Schira et al. | 123/486 |
| 4,164,206 | 8/1979 | Toelle | 123/571 |
| 4,181,944 | 1/1980 | Yamauchi et al. | 364/431 |
| 4,199,812 | 4/1980 | Klötzner et al. | 364/431 |
| 4,201,159 | 5/1980 | Kawai et al. | 123/486 |

*Primary Examiner*—Felix D. Gruber
*Attorney, Agent, or Firm*—Pollock, VandeSande & Priddy

[57] ABSTRACT

An engine control system is provided with a memory having an area addressed by two parameters chosen out of a group of throttle valve position, manifold pressure and engine rotation number, memorizing digital forms of predetermined fuel injection quantities plotted at points separated with a given distance. The values stored in those areas are read out to give a digital form of fuel injection quantity addressed with said parameters introduced by the sensors during the engine operation. The read-out value is multiplied by a coefficient concerning at least one of such detected values as air pressure, aspirated air temperature and engine temperature in order to give a corrected quantity with which the fuel injection is controlled. In this invention the digital controlling quantities stored in the first memory are plotted with short interval and high accuracy where the throttle opening angle is small and the interval is increased with increasing throttle opening angle. It is favorable in this invention to use a higher order bit signal of the parameter for reading out the necessary fuel injection control digital quantity from the memory, and to use a lower order bit signal of the parameter for interpolating the read-out fuel injection quantity.

6 Claims, 27 Drawing Figures

ENGINE FUEL SUPPLY CONTROLLING SYSTEM

FIELD OF THE INVENTION

This invention relates to an engine controlling system for controlling the quantity of fuel supply.

SUMMARY OF THE INVENTION

It is an object of this invention to make a correct or an accurate engine control by using a digitized numerical value associated with the air volume taken into the engine in order to read out a suitable bull injection quantity according to the volume of the aspirated air, and by correcting the read-out digital value with another digital value representing the condition of the aspirated air.

To perform said purpose, in this invention, at least two sensors are provided in the engine to sense values related to the aspirated air volume, and the detected values are fed through address converters to a first memory from which said fuel injection quantity in digital form associated with the aspirated air volume is taken out. In addition, a third sensor is provided to detect the condition of the air being aspirated into the engine. The digital value sensed by the third sensor or the digital value read out from a second memory addressed in response to the third digital value is multiplied by the digital value read out from said first memory. The product is used to control the fuel injection quantity.

DETAILED DESCRIPTION OF THE INVENTION

Figure 1:
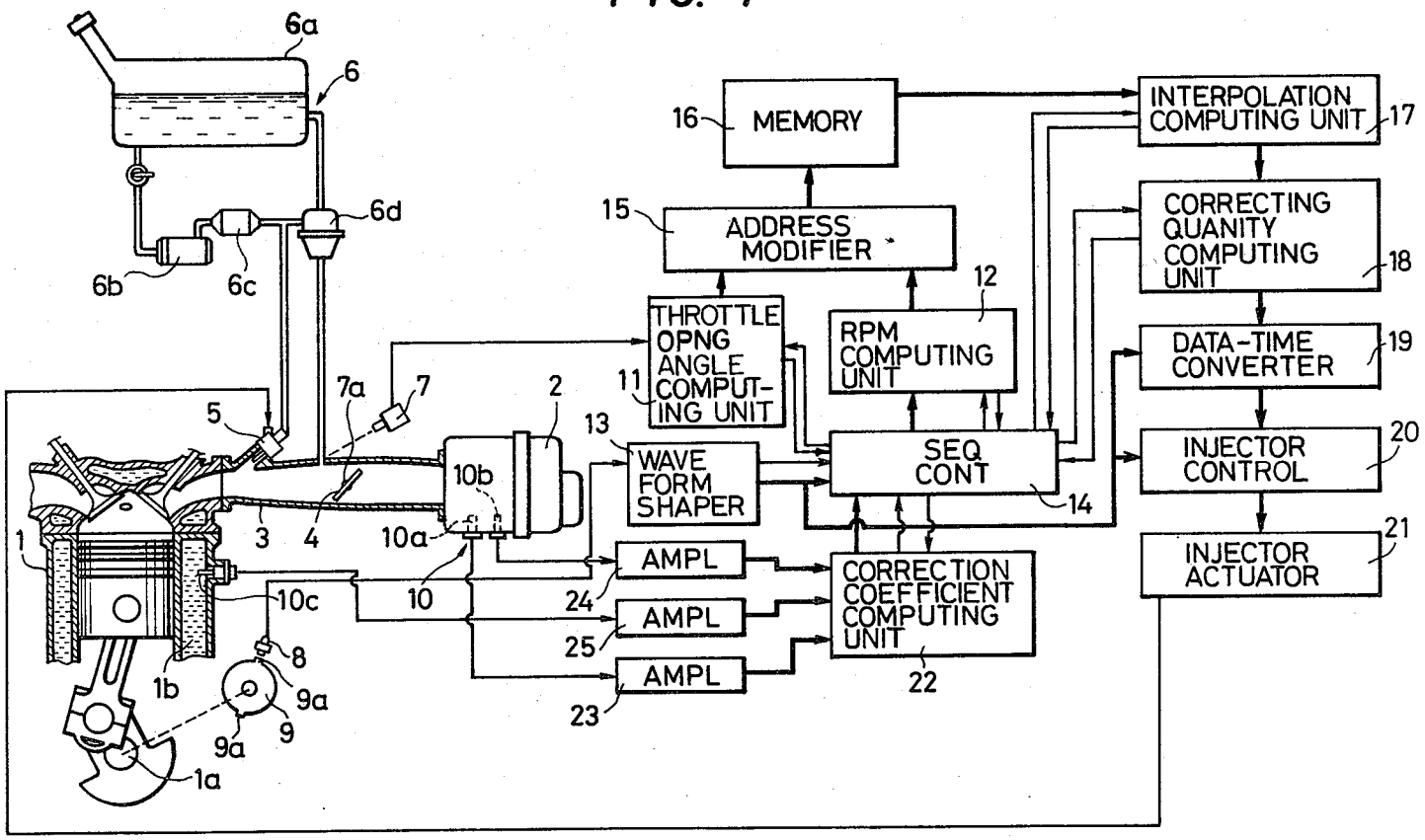
FIG. 1 is a block diagram of a first embodiment of this invention.

An embodiment of this invention will be explained with reference to the block diagram of FIG. 1.

In the figure, reference number 1 denotes an engine, and 2 denotes an air cleaner which is coupled to the intake side of the engine 1 through an intake manifold 3 provided with a throttle valve 4 and a fuel injector 5. The number 6 denotes a fuel supplying system for the injector 5. A first sensor 7 is ganged with the throttle valve 4 so as to get its opening angle in the form of a digital number. A second sensor 8 is a pick-up coil facing a circular plate 9 having projections **9*a*, 9*a* (in case of 4-cylinder-4-cycle engine) which rotates in synchronization with a shaft 1*a*. When either of the projections 9*a*, 9*a* passes under the second sensor 8**, a pulse signal is generated.

A third sensor 10 consists of an air pressure sensor **10*a*, an aspirated air temperature sensor 10*b* and an engine temperature sensor 10*c*. Air pressure sensor 10*a* and the aspirated air temperature sensor 10*b* are provided at the up-stream side of the throttle valve 4 of the air intake manifold 3. The engine temperature sensor 10*c* is mounted inside the water jacket 1*b* of the engine body, but it may be replaced by a device capable of detecting the lubricating oil temperature in an air-cooled engine. The number 11 denotes a throttle opening angle computing unit connected with the first sensor 7; 12 denotes an engine rotation number computing unit connected through a waveform shaper 13 and a sequence control unit 14 to a second sensor 8; 15 denotes an address converter or modifier controlled by higher order bits of the digital value of each output of the throttle opening angle computing unit 11 and engine rotation number computing unit 12; 16 denotes a memory unit for supplying information in response to an address signal from the address converter or modifier 15**.

Each address of the memory unit 16 stores a digital form of numerical value representing the fuel injection quantity necessary for the aspirated air volume introduced by the throttle opening angle and the engine rotation number. Therefore, the memory unit 16 gives a digital value representing the quantity of fuel injection fitted for the throttle opening angle and the engine rotation number at that time. Generally, a large scale computer is needed in the computation of necessary quantity of fuel injection, using the throttle opening angle and the engine rotation number, because it must treat high order functions. The memory 16 for memorizing computed digital values, however, eliminates the need of using a large scale computer.

Furthermore, for an engine which is to operate in an area where there are severe restrictions on pollution gas discharge, or where it is desired to achieve higher power output and less fuel consumption, only a change of the values stored in the memory can achieve the desired fuel injection control, i.e., to increase the quantity of fuel which is injected when the engine is operating under heavy load or at a high speed of rotation, and to reduce the quantity of fuel which is injected when the engine is operating in a medium or light load range. In this method, the fuel injection control data are determined by only addressing the memory, without any calculating or computing. Therefore, this method is superior to and less difficult than computing the fuel injection quantity required to satisfy each of these possible conditions.

The number 17 denotes an interpolation computing unit for converting the round or roughly estimated digital value obtained from the memory unit 16 to a more accurate digital value. As mentioned above, higher order bits of the digital values fed from the throttle opening angle computing unit 11 and the engine rotation number computing unit 12 are applied to the address modifier 15 which in turn addresses the memory unit 16 to read out a digital value representing a fuel injection quantity in accordance with the instantaneous throttle opening angle and the instantaneous engine rotation number within a given range.

For further accurate control of the engine, the interpolation computing unit 17 computes the interpolation in order to obtain the intermediate value within a limited segment by receiving the output digital value of the memory unit 16 together with the lower bits of the digital outputs of the throttle opening angle computing unit 11 and the engine rotation number computing unit 12 fed through the sequence control unit 14.

The reason why the interpolation computation is available is that even a curve expressed by a high order function may be replaced by a combination of short straight lines. In this invention, the curve is approximated with as many segments as the memory capacity, and hence the memorized value varies from one to another linearly in a segment.

The digital value resulting from the interpolation computation in the interpolation computing unit 17 is corrected at the correcting quantity computing unit 18, and converted to a time interval at the data-time converter 19 which gives an output to control the injector driver actuator 21 through the injector control unit 20, thereby controlling the fuel injection period of the injector 5 for a proper fuel injection depending upon the volume of the air aspirated into the engine.

The correcting quantity computing unit 18 is connected through the sequence control unit 14, correction coefficient computing unit 22 and amplifiers 23, 24, 25 to the air pressure sensor 10*a*, aspirated air temperature sensor 10*b* and the engine temperature sensor 10*c*. The correcting quantity computing unit 18 multiplies the digital output of the interpolation computing unit 17 by the correction value depending upon the values of the air pressure sensor 10*a*, aspirated air temperature sensor 10*b* and the engine temperature sensor 10*c* digitized at the correction coefficient computing unit 22, in order to correct the digital output from the interpolation computing unit 17 to a desired digital quantity of fuel injection according to the mass or weight of the aspirated air. It goes without saying that the engine operated under a constant air pressure and temperature needs no such correcting devices.

The data-time converter 19 is connected through waveform shaper 13 to a crank angle sensor or a second sensor 8, receiving the output signal of the sensor 8, producing a trigger pulse after a time lapse of fuel injection period corresponding to the digital output of correcting quantity computing unit 18.

The injector control unit 20 is a flip-flop circuit, is connected through a waveform shaper 13 to the second sensor 8, receives enabling instruction at the same time as the data-time converter 19, and turns to a set condition, so that it keeps applying the enabling signal for the fuel injector to the injector driver 21. Consequently, the valve of the injector 5 is held at its "open" position, allowing the fuel injection into the manifold 3. The injector control unit 20, receiving a trigger signal from the data-time converter 19, returns to its reset state and stops generating the enabling signal of the injector 5, thereby ending the fuel injection.

As is described above, in this invention the throttle opening rate computing unit 11 and the engine rotation number computing unit 12 give their higher order bits to the address converter 15 whose address signal is used to read out, from each address of the memory unit 16, a digital value representing the fuel injection quantity within a certain range of the engine speed. On the other hand, this digital value and the lower order bits of the throttle opening angle computing unit 11 and the engine rotation number computing unit 12 are supplied to the interpolation computing unit 17 where a computation is carried out to give an intermediate value in a certain range. For correction, this intermediate value is multiplied, at the correction computing unit 18, by the digital values obtained from the air pressure sensor 10*a*, aspirated air temperature sensor 10*b* and the engine temperature sensor 10*c* so that it may be corrected to a desired value in accordance with the conditions of the aspirated air and the engine. The corrected value is used to control the work period of the injector 5. The engine, therefore, is kept operating in an optimum condition.

Moreover, in case of controlling the fuel injection quantity according to the weight of the aspirated air derived from the aspirated air volume and its condition (temperature t and pressure p), the correction quantity depending upon the temperature, pressure, etc. is easily computed, since a simple operation will give a corrected quantity proportional to the product of the correction coefficient $$\left(\frac{p}{p_o} \text{ or } \sqrt{\frac{273 + t_o}{273 + t}}\right)$$

and the volume of the aspirated air. Therefore, in this embodiment, the said correction is conducted by the operating system. In that case, the memory capacity can be less than that of the system where the memory address is designated by three parameters, aspirated air volume, temperature and pressure.

Operation of the fuel supplying system 6 is as follows: The gasoline in the fuel tank 6*a* is fed by feed pump 6*b* to the injector 5 provided at the air intake manifold 3 of the engine through a filter 6*c*. With the pressure of the fuel kept at a constant pressure difference from the internal pressure of the air intake mainfold, the open period of the injector 5 will be proportional to the injection quantity of fuel. To attain the effect, a fuel pressure regulator 6*d* is provided with its fuel pressure port coupled to the injector 5, its negative pressure port directed to the air intake manifold 3 and the leak hole to the fuel tank, and keeps the pressure difference constant by controlling the fuel leakage according to the result of comparison of the fuel pressure of the injector 5 to the internal pressure of the air intake manifold.

The fuel supply system 6 makes it possible to supply a sufficient amount of fuel while the valve of the fuel injection nozzle is being opened by a solenoid mounted at the fuel injection nozzle and energized with an electrical enabling signal for opening the fuel injection nozzle only during the time period corresponding to the digital value by the computer.

The second sensor 8, or crank angle sensor, generates a train of pulses having a pulse interval inversely proportional to the engine rotation number or speed. The engine rotation number is calculated from the pulse interval. The engine rotation number and said throttle opening angle are related, with a certain function, to the volume of the air taken into the engine, and therefore the function with its variables substituted with the engine rotation number and the throttle opening angle will give the volume of the air aspirated in one aspiration stroke. Under an assumption that the air pressure sensor output 10*a* and the aspirated air temperature sensor output 10*b* are p and t respectively; the aspirated air density is given by $$\frac{p}{p_o} \cdot \frac{273 + t_o}{273 + t}.$$

Multiplication of the volume of the aspirated air by the density will give the weight of the corrected aspirated air per aspiration stroke. The corrected weight of the air is used to control the quantity of the fuel injection for almost ideal combustion of supplied fuel.

The engine temperature sensor 10*c* is used for incremental or decremental correction of the fuel supply according to the temperature of the operating engine.

Figure 2:
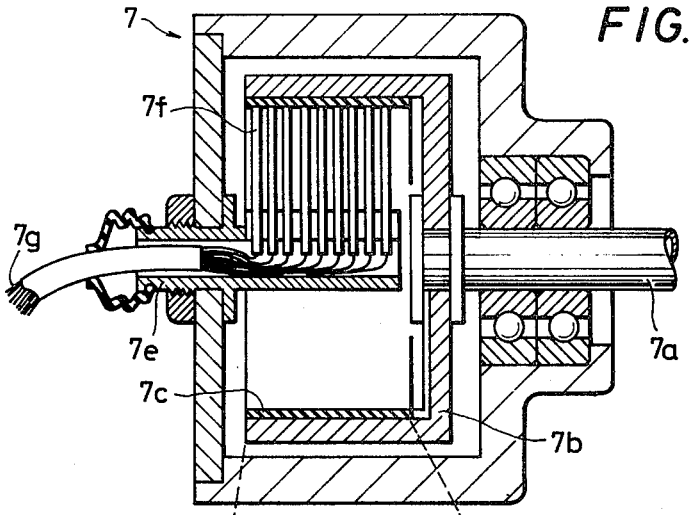
FIG. 2 is a side view of a first sensor cut along the center line thereof.
Figure 3:
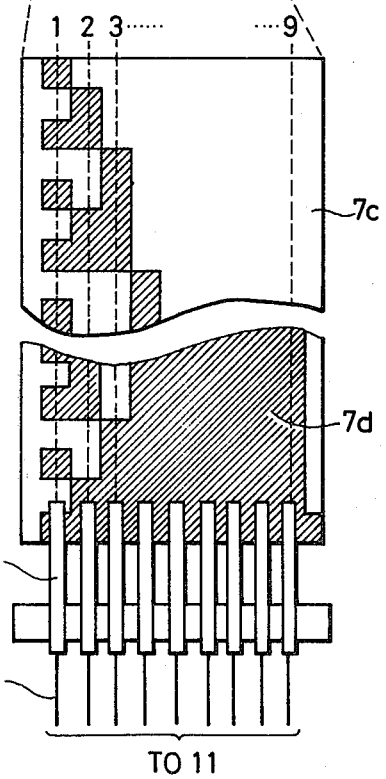
FIG. 3 is an developed view of the insulating plate shown in FIG. 2.

Next, a further detailed explanation will be made of each part of the embodiment. In a system where the first sensor 7 gives the throttle opening angle as an analog quantity, it must be converted to a digital quantity. In this embodiment, as shown in FIGS. 2 and 3, a rotatable shaft 7*a*—connected with the shaft of the throttle 4—is engaged in a body with a drum 7*b* having an inner surface on which an insulating plate 7*c* is seated. Over the surface of the insulating plate, a conductor 7*d* is provided to form eight bit binary codes. A fixed shaft 7*e* is provided inside the drum 7*b*, with eight brushes 7*f* each connected to the throttle opening angle computing unit 11 through a lead wire 7*g*.

Figure 4:
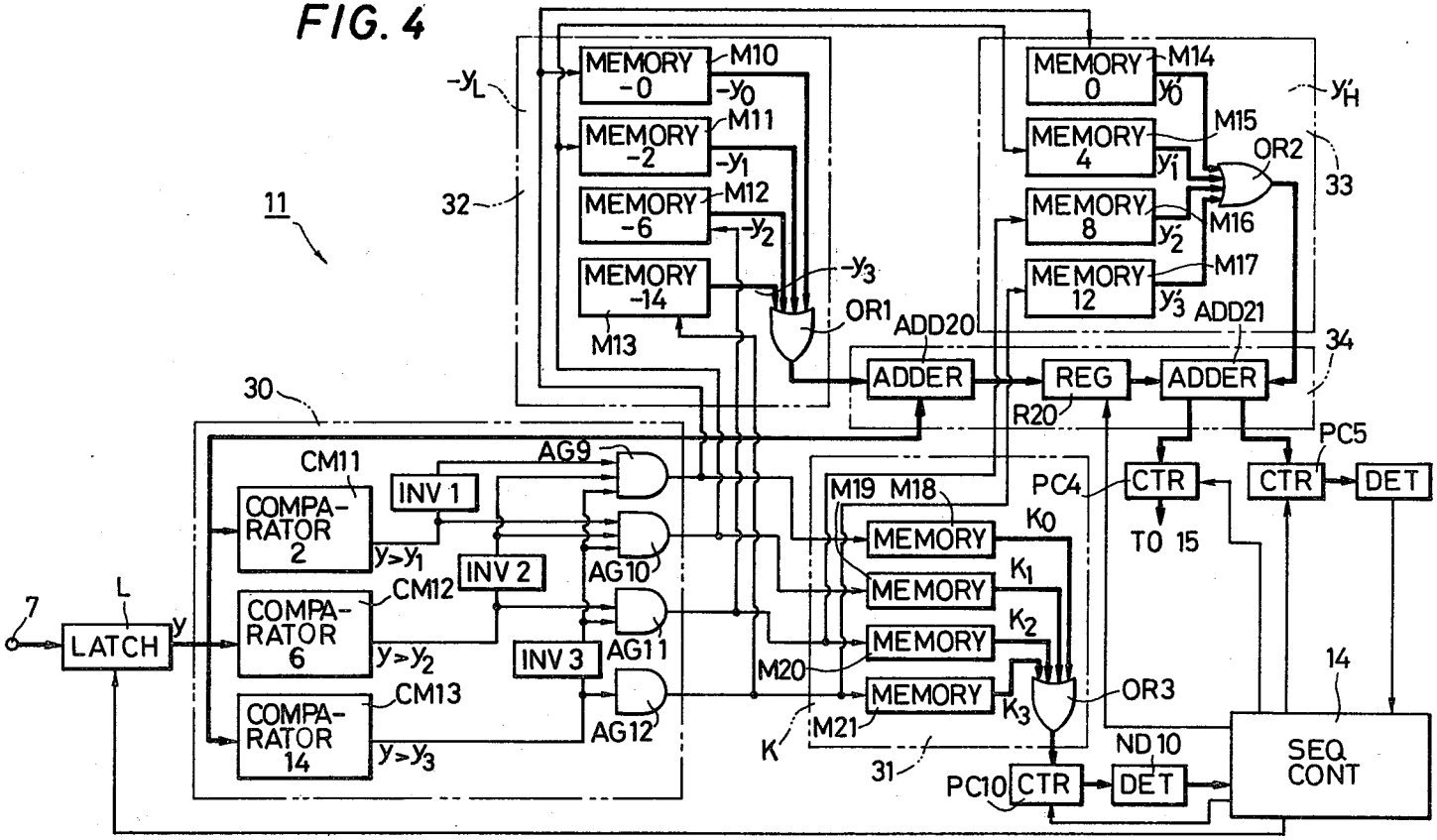
FIG. 4 is a block diagram of the throttle opening angle computing unit.

Out of the eight bits of the digital value produced at the first sensor 7, the four higher bits are fed to a preset counter PC4 of FIG. 4 in order to address a predetermined area of the memory unit 16, and the four lower order bits are fed to the preset counter PC5 of FIG. 4 for interpolation computation.

In this embodiment, the throttle opening angle computing unit 11 carries out a non-linear operation to get higher accuracy of fuel injection quantity. The non-linear operation will be explained with reference to FIGS. 5 and 6 together with FIG. 4.

Figure 5:
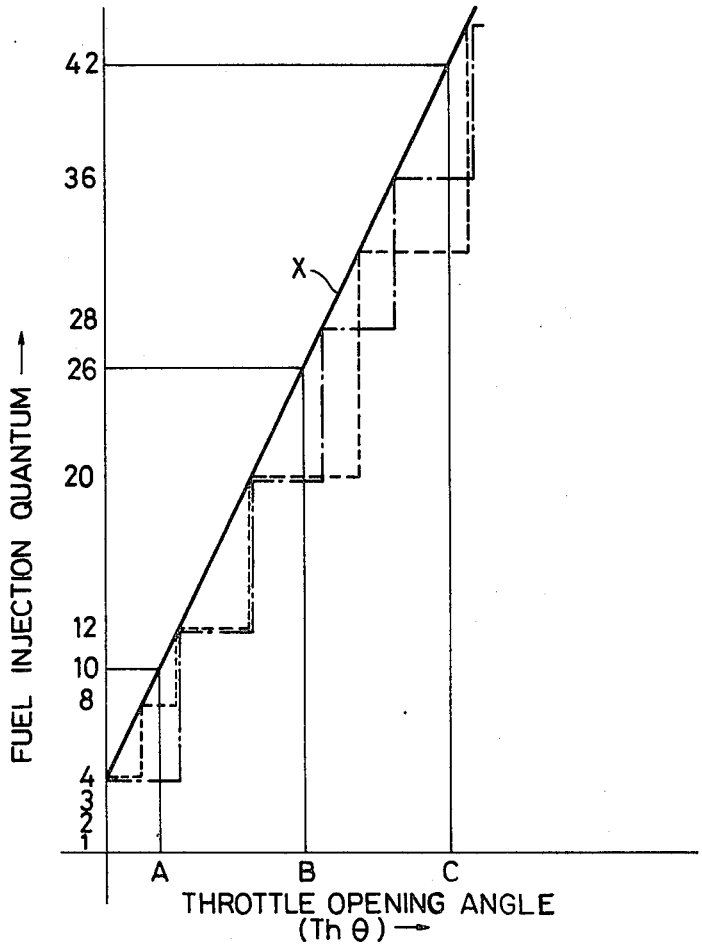
FIG. 5 graphically shows a relation between the throttle opening angle and the fuel injection quantity.

Now an assumption is made that the quantity of injected fuel is related to the throttle opening angle Th$\theta$ in accordance with the line X of FIG. 5. This relation is stored in the digital memory in the form of fuel injection quantities measured at the points where the line X is divided into equal segments. Therefore, an approximation of the relation is obtained by reading the content of the memory according to the throttle opening angle Th$\theta$. This is shown by a dot-and-dash line in FIG. 5.

The line shows that digital expression of line X causes error in the intermediate part of the segments. Following are errors computed for the throttle opening angles A, B and C, with reference to an equal division method shown by the dot-and-dash line. Although the true numerical value at the point A is 10, the approximated value at the dividing point is 4. The error rate is given by the following equation:

$$\frac{\text{approximated value} - \text{true numerical value}}{\text{true numerical value}} \times 100\%$$

In consequence, the error rate at point A is—60%. Similarly, the error rate at B is—23% and that at C is—12%. The above mentioned error rate indicates that it decreases with increasing throttle openig angle.

With this in mind, the line X is divided into shorter segments at less throttle angle of the throttle valve and into longer segments at larger throttle angle of it, as shown by dotted line in FIG. 5. The error rates at points A, B and C, in that case, are given similarly by the error rate at point A:—20%
the error rate at point B:—23%
the error rate at point C:—24%

Thus, the unequal division gives almost equal error rate.

Furthermore, the throttle valve has the property that a slight change in opening angle introduces a great change in quantity of aspirated air stream at less opening angle region, and a small change in the quantity at larger opening angle region. Therefore, a greater inequality of the division will minimize the errors in the lower opening rate region, improving the accuracy of the fuel injection control at lower opening angle region of the throttle valve. In addition, if the line X is a curve, it is desired to have a fine division at the part where the curvature is large for increasing the accuracy of the interpolation computing that will be described hereinafter.

Now an explanation is made about the operation of the throttle opening angle computing unit 11 including its non-linear operation. An important function of the throttle opening angle computing unit is to convert the throttle opening angle, fed in as a digital value, to a digital value fit for the address converter and interpolation computing unit. To help to understand this, reference is made to FIG. 6. The bottom rows of this Figure give the throttle opening angles Th$\theta$ and their digitized values for every 2.5 degree. These digital values are given by the throttle opening angle sensor 7. The left end columns indicate the digital value A applied to the address converter 15 and the digital value B for interpolation computation. In the figure, the solid line gives the relation between the two higher order bits fed to the address converter 15 and the two lower order bits for interpolation computation out of the five-bit output of the throttle opening angle sensor 7, and the dots-and-dash line gives the relation in case of non-linear operation.

Following is an equation being computed at the throttle opening angle computing unit 11 including non-linear operation part.

$$y' = K(y_A - y_L) + y'_H$$

Figure 7:
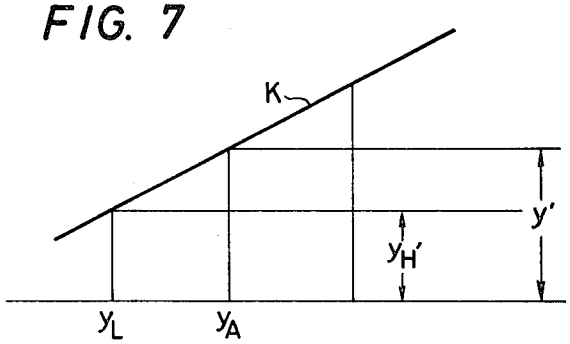
FIG. 7 is a drawing for use in explaining FIG. 6.

This equation gives a conversion of throttle opening angle $y_A$ to y'. The relation given by this equation is illustrated in FIG. 7. The slope is denoted by K and ts variation is plotted by a dotted line or a step variation line shown by a dots-and-dash line of FIG. 6. In FIG. 7, $y_L$ is an initial value of the throttle opening angle or a value of the throttle opening angle at the points where K changes. $y'_H$ is a set value at point $y_L$.

A computation process of the equation is explained with reference to the circuit diagram of FIG. 4. The throttle opening angle computing unit 11 is roughly divided into the following three sections:

1. a constant memory designating section 30; this section selects constants for non-linear operation in accordance with the throttle opening angle Th$\theta$.
2. a first to third constant memories 31, 32, 33; memorizing K,—$y_L$ and $y'_H$. In this embodiment, they consist of four memories because the non-linear operation is divided into four stages.
3. a computing unit 34; for addition and multiplication of memorized constant and the throttle opening angle.

In the explanation of the operation of the computing unit, the following are presupposed (the example taken here is the dots-and-dash line of FIG. 6):

(a) Output of the throttle opening angle sensor is of 5 bits.
(b) Preset counter PC4 is of 2 bits.
(c) Preset counter PC5 is of 2 bits.
(d) Comparator CM11 pulses for ya>$[10]_2$:ya is value of throttle opening angle.
(e) Comparator CM12 pulses for ya>$[110]_2$
(f) Comparator CM13 pulses for ya>$[1110]_2$
(g) value 0 stored in constant memory M10=$y_L$

| | | | | |
|---|---|---|---|---|
| (g) | value | 0 | stored in constant memory | M10 = YL |
| | " | $[10]_2$ | " | M11 = YL |
| | " | $[110]_2$ | " | M12 = YL |
| | " | $[1110]_2$ | " | M13 = YL |
| | " | 0 | " | M14 = Y'H |
| | " | $[100]_2$ | " | M15 = Y'H |
| | " | $[1000]_2$ | " | M16 = Y'H |
| | " | $[1100]_2$ | " | M17 = Y'H |
| | " | $[11]_2$ | " | M18 = K |
| | " | $[10]_2$ | " | M19 = K |
| | " | $[1]_2$ | " | M20 = K |
| | " | 0 | " | M21 = K |

The digital output from the sensor 7 is applied through latch L to comparators CM11, CM12 and CM13 for selection of constant memory, and to ADD 20.

Each comparator compares a digital output of the throttle opening angle sensor 7 with its set value and gives a pulse for the digital value larger than the set value.

Comparator CM11 is connected through inverter InV1 to AND gate AG9 and directly to AND gate AG10. The comparator CM12 is connected through inverter InV2 to AND gates AG9 and AG10, and directly to AND gate AG11. The comparator CM13 is connected through inverter InV3 to AND gates AG9, AG10 and AG11 and directly to AND gate AG12. With this circuit configuration, if the sensor gives a digital value less than $[10]_2$, no comparators pulse. Therefore, the AND gates AG10, AG11 and AG12 directly connected to the comparator give no pulses for selecting memories. On the other hand, inputs to the AND gate AG9 are all connected through inverters InV1, InV2 and InV3 to the comparators CM11, CM12, CM13, and hence AND gate AG9 receiving pulses at its three input terminals gives an output pulse for selection of memory.

When the digital value from the throttle opening angle sensor is less than $[110]_2$ and is $[10]_2$ or more, only comparator CM11 gives a pulse, and AND gates AG11 and AG12 directly connected to the comparators CM12 and CM13 do not pulse. As comparator CM11 gives a pulse, no pulse appears at the output of inverter InV1, and therefore AND gate AG9 gives no pulse. The AND gate AG10 directly connected to comparator CM11 and through inverters InV2 and InV3 to comparators CM12 and CM13 receives pulses at its three inputs and gives an output pulse.

Thus, when the digital value from throttle opening angle sensor is less than $[1110]_2$ and $[110]_2$ or more, only AND gate AG11 pulses and when the digital value is $[1111]_2$ or more, only AND gate AG12 pulses.

As is understood from the above description, according to the digital value of the sensor 7, one of the AND gates pulses. These AND gates are connected with constant memory 31 for storing K, memory 32 for storing—$y_L$ and memory 33 for storing $y'_H$. Therefore, pulses come from those AND gates in response to the throttle opening angle are applied to the constant memories which are required to be read. For instance, when the digital value of the sensor is $[110]_2$, AND gate AG10 pulses to the constant memory M19 in which K is stored, M11 in which—$y_L$ is stored, and M15 in which $y'_H$ is stored, thereby constant memory M19 giving $[10]_2$, M11 giving $[-10]_2$ and memory M15 $[100]_2$. In the manner mentioned above, values necessary for the computation of $y'=K(y_A-y_L)+y'_H$ are obtained.

Next, the computation process will be described. First, the negative value $y_L$ from the constant memory selected by an AND gate is applied through OR gate OR1 to Adder ADD20 where it is added to the digital value from the throttle opening angle sensor. The result $(y_A-y_L)$ is stored in register R20. This computation may be an addition of two's complement stored in the constant memory. The value K from the constant memory addressed by an AND gate output is brought through OR gate OR3 to preset counter PC10 where it is stored. The zero detector ND10 supervises zero indication of the counter PC10. When detecting a zero indication, the detector informs it to the sequence controller 14 in order to shift down the value $(y_A-y_L)$ stored in the register R20 by 2 bits to give the value $\frac{1}{4}(y_A-y_L)$.

When the content of the counter PC10 is not zero, the sequence controller 14 controls the preset counter PC10 to count down to the zero, and the value $(y_A-y_L)$ in the register R20 is shifted up by the number of the countdown. When the preset counter PC10 reaches zero count, the value $(y_A-y_L)$ in the register R20 at that time is shifted down by two bits to give $K(y_A-y_L)$. Generally, if a value stored in a register is shifted by one bit, the value is doubled in binary expression. For example, a one-bit shift-up of $[11]_2=3$ results in $[110]_2=6$.

The value $y'_H$ in the constant memory addressed by the output of an AND gate is fed through OR gate OR2 to adder ADD21 where it is added to $K(y_A-y_L)$ supplied from register R20 to give a sum $K(y_A-y_L)+y'_H$. The two higher order bits of the sum are applied to preset counter PC4 connected to address counter 15, and two lower order bits are applied to preset counter PC5 for interpolation computation.

Figure 6:
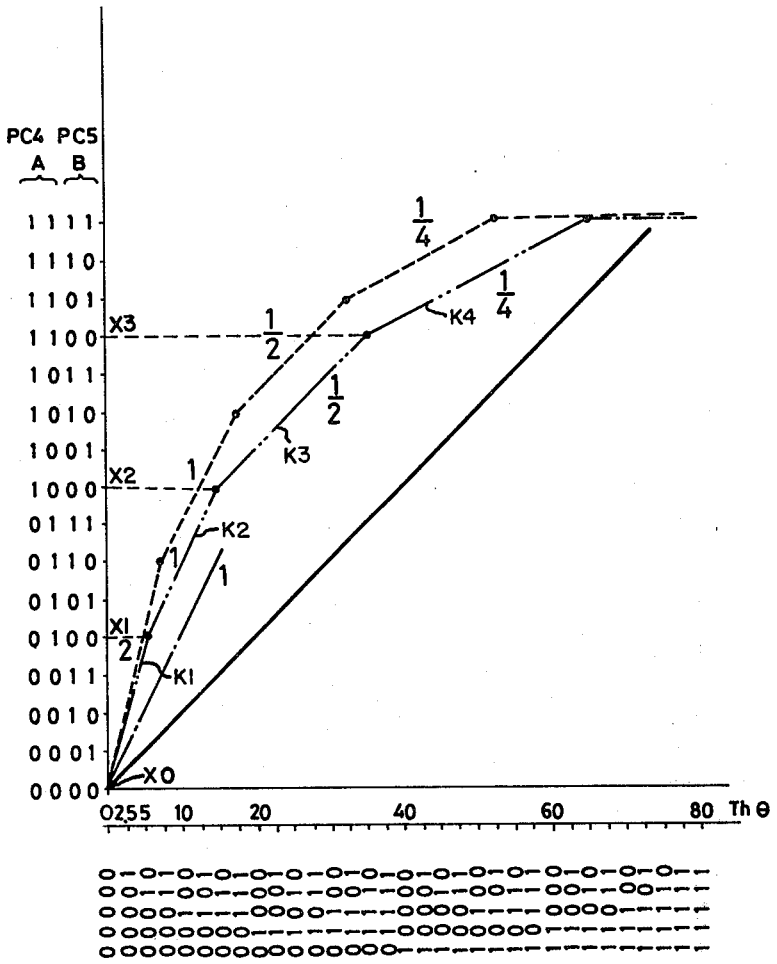
FIG. 6 graphically shows the result of the computation in the throttle opening angle computing unit.

In the above description, explanation was made on an example with reduced bit number, but for obtaining desired accuracy, the output of the throttle opening angle sensor must be nine bits or more, the preset counter PC4 and PC5 must have four or more bits, and each constant must be determined at the value indicated with dotted line in FIG. 6. The numeric symbols in the figure represent constant K, and the points where the value of K changes are the points where the higher order bits of the preset counter are changed.

Instead of the throttle opening angle sensor 7, a strain gauge element may be adopted to detect the pulsating current pressure of the aspirated air in the manifold, which is demodulated at a demodulator to give the volume of the aspirated air. The result is used after A-D conversion. In this case, the engine rotation number computing unit may be eliminated. It is, however, possible to obtain more accurate volume of the aspirated air based on the engine rotation number derived from the output of said strain gauge element and the demodulated signal.

Next, an explanation will be made as the engine rotation number computing unit 12 of FIG. 8, which counts the pulse interval of the pulses from the crank angle sensor 8 by using a series of reference pulses, giving a digital value representing the engine rotation number. Where the crank angle sensor is adopted to detect the engine rotation number, it gives output pulses whose interval becomes shorter with increasing engine rotation number. That means, the engine rotation number is given by the reciprocal of the pulse interval. In other words, it is computed by Engine Rotation Number = K/a value representing the reciprocal of the engine rotation number (value at counter C2)

Here, a computation of the reciprocal will be explained briefly. The digital value representing the engine rotation number is derived from a division of an arbitrary integer K stored in the constant memory K1 by a value C in the counter C2. Following are an example of the pulse numbers given under the assumption that the engine rotation numbers are 1000(rpm), 2000(rpm), 3000(rpm), and time lag in reading the reference pulses, or the number counted during the gate G1 is closed as will be described later is A. The number of pulses passing through the gate G1 in the interval between two pulses from the crank angle sensor 8 is 6000—A(pulses) for the engine rotation number of 1000(rpm), 3000—A(pulses) for 2000(rpm), 2000—A(-pulses) for 3000(rpm), and 1500—A(pulses) for 4000(rpm). If the arbitrary integer from the constant memory K1 is 300,000, the result of the division is $$\frac{300{,}000}{6000 - A} \text{ for 1000(rpm)}$$

As the value A is very small compared with the reference pulse number, it can be disregarded, and the approximation is 300,000/6000 = 50. Similarly, the quotients are 100, 150, and 200 for the engine rotation numbers 2000 (rpm), 3000 (rpm) and 4000 (rpm) respectively. Thus, the values representing the engine rotation numbers are obtained.

The engine rotation number computing unit 12 employs binary words, and the subtraction is carried out by an adder. An example will be given wherein the division 8÷2 is carried out in hexadecimal number. The decimal number 8 is expressed by $[1000]_{16}$ in hexadecimal number and the decimal number 2 by $[0010]_{16}$. If the number 2 is repeatedly subtracted from 8 until the remainder becomes 0, the number of the subtraction gives the quotient of the calculation 8÷2.

In this invention, an adder is used to perform the subtraction. Therefore, the binary expression $[0010]_2$ of 2 is counted to one's complement $[1101]_{16}$ at the inverter (IN1), then 1 is added to the complement at the preset counter PC3 to give two's complement $[1110]_{16}$. Addition of two's complement $[1110]_{16}$ to $[1000]_{16}$ gives a first sum $[10110]_{16}$. Where, the most significant bit overflows and the adder indicates $[0110]_{16}$. In the same manner, the second addition gives $[1110]_{16}$, third addition $[1111]_{16}$, and the fourth addition $[0000]_{16}$. It is obvious that the number of subtraction is 4, therefore the quotient is $[0100]_{16}$ in hexadecimal expression.

Figure 8:
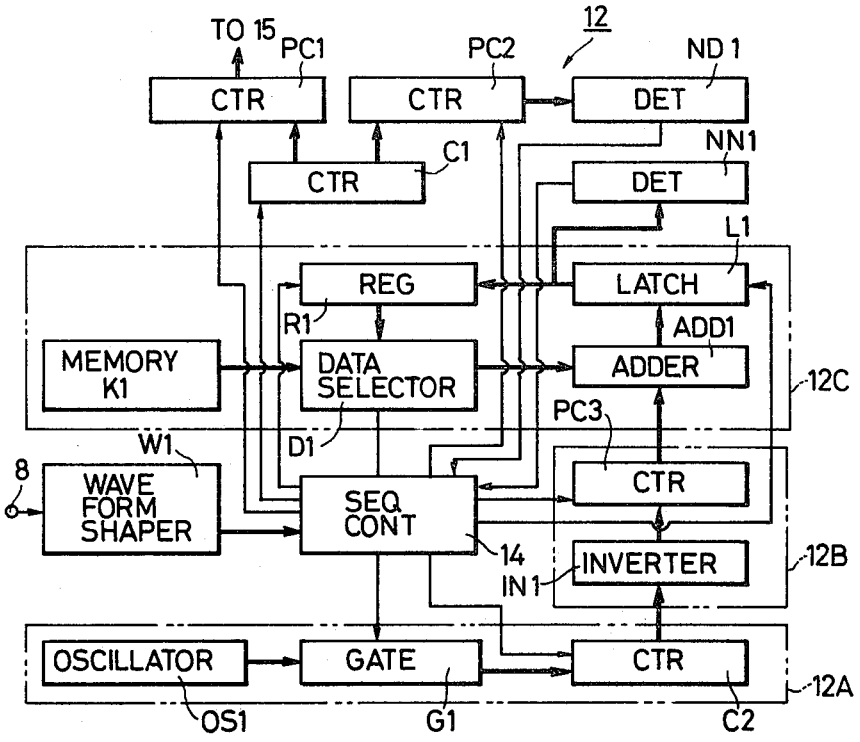
FIG. 8 is a block diagram of the engine rotation number computing unit.

As shown in FIG. 8, the engine rotation number computing unit 12 is roughly divided into three parts 12A–12c.

1. Engine Rotation Number Converter:

The engine rotation number converter 12A uses a train of reference pulses to count the interval between two input pulses from the crank angle sensor, giving a digital value inversely proportional to the engine rotation number. The output pulses of the crank angle sensor 8 whose waveforms are shaped at the waveform shaper W1 into rectangular waves are supplied to the converter through the sequence controller 14. Gate G1 closes for the pulse duration every time the output of the shaper W1 is applied. The counter C2 counts the reference pulses from oscillator OS1 during the period the gate G1 is open.

Although the reference pulses are not passed to the counter C2 while the gate G1 is closed, the number of the blocked reference pulses is small enough to be disregarded compared with the number of passed pulses, therefore the count of the counter C2 can well approximate the numerical value inversely proportional to the engine rotation number.

2. Complement Computing Unit:

The complement computing unit 12B produces a two's complement of the digital value fed from the engine rotation number converter and gives it to the reciprocal computing unit 12C where a digital number proportional to the engine rotation number is produced. The digital number from the counter C2 is inverted at the inverter IN1 to get the one's complement (e.g. $[1001]_{16}$ is converted to $[0110]_{16}$) before being fed to the preset counter PC3. The counter PC3 produces the two's complement (e.g., $[0110]_{16}$ is converted to $[0111]_{16}$) by adding "1" to the one's complement. The output is fed to the reciprocal computing unit.

3. Reciprocal Computing Unit:

In the reciprocal computing unit 12C, integer K stored in the constant memory K1 is applied through a data selector D1 to an adder ADD1 where it is added to the output from the complement computing unit, and the sum is stored in the latch L1. If the value stored in the latch is zero or negative, it is detected by a null detector NN1 and computation ends. If an integer in the latch L1 is larger than the minuend it is written in register R1 and then fed through data selector D1 to adder ADD1 where it is added again as an output of the complement computing unit. The above process is repeated until the indication of latch L1 becomes zero or negative, and at the zero or negative count, the detector NN1 signals the end of the computation. The number of additions is counted by the counter C1 every time an addition takes place. Thus, a digital number representing a quantity proportional to the engine rotation number is produced.

Figure 9:
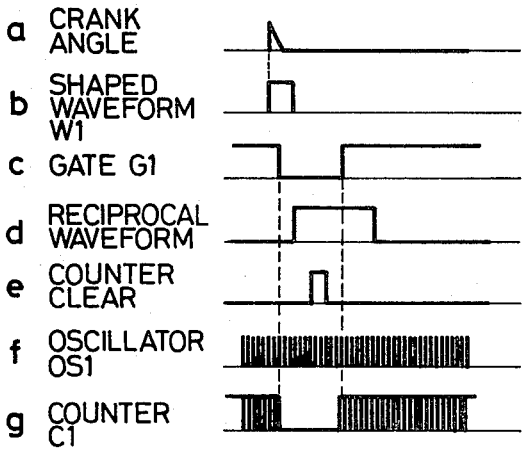
FIG. 9 is a time chart of the unit shown in FIG. 8.

Higher order bits of the digital number are counted by the preset counter PC1 which is connected to address converter 15 for designating a memory address of the memory M1, and the lower order bits are counted by the preset counter PC2 which is connected to the interpolation computing unit. In the explanation above, the time sequence down to the operation of counter C1 is illustrated in FIG. 9.

Address converter 15 and memory 16 are explained below: An address of the memory is determined according to a volume of aspirated air in the combustion engine, which is a combination of the opening angle of the throttle valve and the engine rotation number. In the area addressed, the fuel injection period is memorized to supply basic data for engine control.

1. Address Converter

Figure 10:
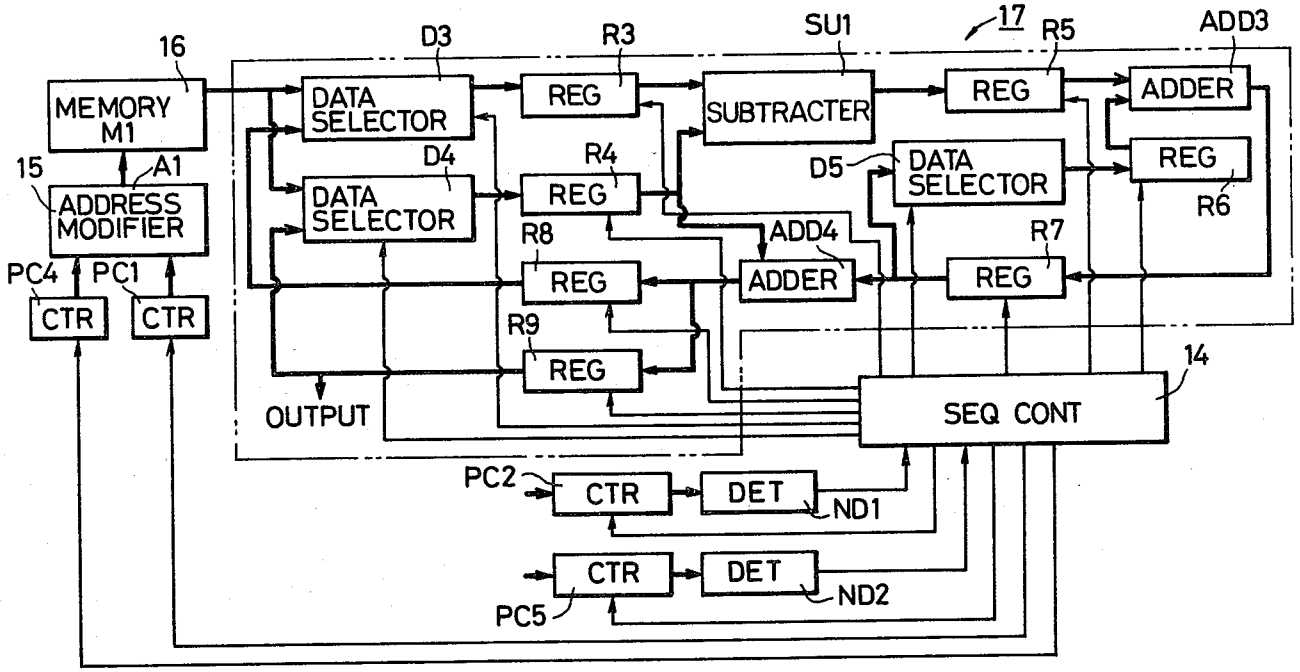
FIG. 10 is a block diagram of the interpolation computing unit.

The address converter or modifier 15 of FIG. 10 receives through preset counters PC1, PC4, higher order bits of each output of the throttle opening angle computing unit 11 and the engine rotation number computing unit 12 to designate an address of the memory 16. For example, data for addressing the memory 16 include the engine rotation number consisting of 2 bits A, B and throttle opening angle consisting of 2 Bits C, D. Table 1 tabulates the truth values.

TABLE 1

| A | B | C | D | Address |
|---|---|---|---|---|
| 0 | 0 | 0 | 0 | 0 |
| 0 | 0 | 0 | 1 | 1 |
| 0 | 0 | 1 | 0 | 2 |
| 0 | 0 | 1 | 1 | 3 |
| 0 | 1 | 0 | 0 | 4 |
| 0 | 1 | 0 | 1 | 5 |
| 0 | 1 | 1 | 0 | 6 |
| 0 | 1 | 1 | 1 | 7 |
| . | . | . | . | . |
| . | . | . | . | . |
| . | . | . | . | . |
| 1 | 1 | 0 | 1 | 13 |
| 1 | 1 | 1 | 0 | 14 |
| 1 | 1 | 1 | 1 | 15 |

2. Memory Unit M1

The memory 16 has an area addressed by throttle opening angle and engine rotation number, in which desired fuel injection period is stored. An optimum value is read out from the memory area addressed in accordance with the operating condition of the engine. This memory is, for example, of matrix circuit configuration.

Figures 11, 12:
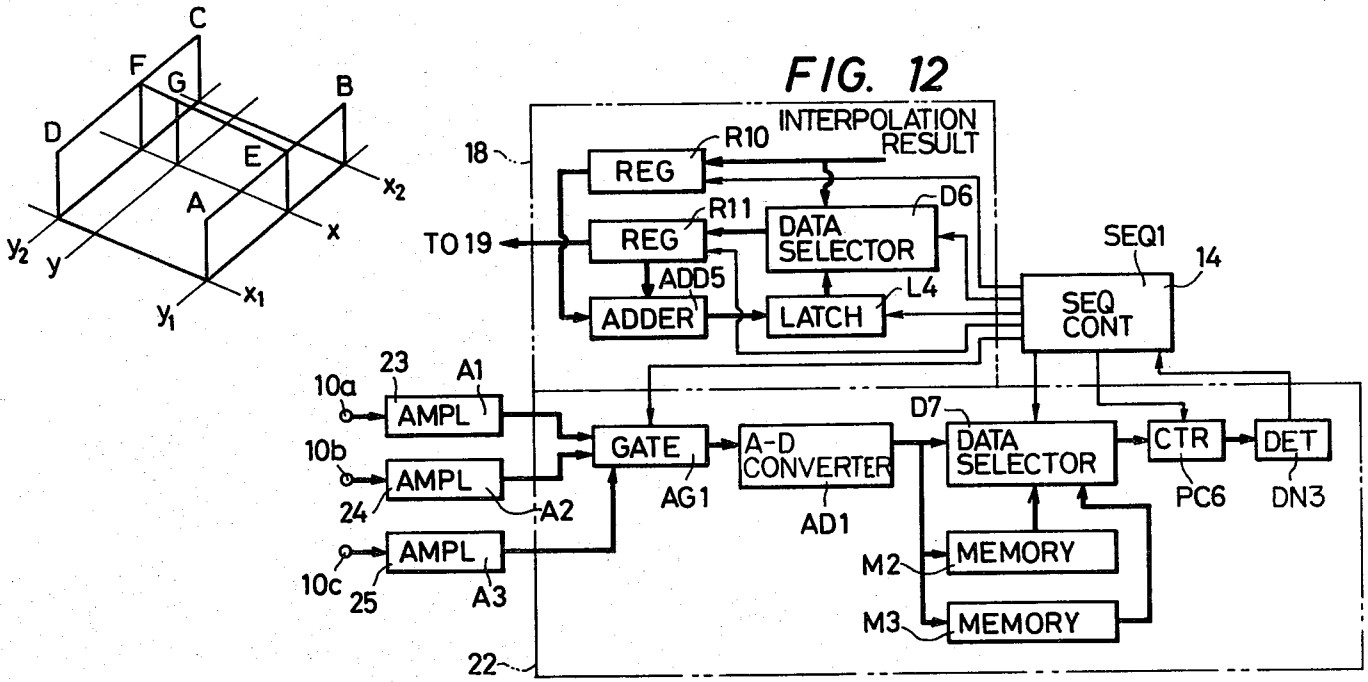
FIG. 11 is a drawing for use in explanation of operation of the interpolation computing unit.
FIG. 12 is a block diagram of the correcting quantity computing unit.

Next, interpolation computing unit 17 will be explained with reference to FIG. 10. This computation is required for computing an intermediate value G (FIG. 11) between a given value and the adjacent value memorized in the memory 16. In this invention, three interpolation computations are required, because the functions of engine rotation number and throttle opening angle and the intermediate value of them must be computed. In FIG. 11, x is a variable representing engine rotation number, and y is a variable representing the throttle opening angle. The variables are assumed to be A(yl, xl), B(yl,x2), C(y2,x1) and D(y2,x2). First, using A and B, E is obtained by the following equation:

$$E = A + \frac{1}{(x2 - x1)}(B - A)(x - x1)$$

Second, using C and D, F is obtained by $$F = C + \frac{1}{(x2 - x1)}(D - C)(x - x1)$$

Finally, G is calculated by using E and F;

$$G = E + \frac{1}{(y2 - y1)}(F - E)(y - y1)$$

This computation will be explained along with the step of the operation of the interpolation computing unit. To compute the interpolation with digital numbers, it is necessary to divide the interval between x1 and x2 into several equal segments expressed by an integer. This is because the frequency of addition must be given by an integer due to the fact that an adder is used for the multiplication. In this embodiment, the interval between x1 and x2 are divided into 16 equal segments, and the quantity to be interpolated is expressed by the frequency of the addition in accordance with the position where the intermediate value x is present. In more detail, (x2−x1) is 16 and the intermediate value (x−x1) is given by a certain one of the numbers from integers 0 to 15. The interval between x1 and x2 may be divided into 32 equal segments or more.

The result of the computation at the engine rotation number computing unit 12 includes higher order bits fed to preset counter PC1 for addressing the memory 16 and lower order bits representing intermediate value and fed to preset counter PC2 for interpolation computation. The result of the computation at the throttle opening angle computing unit 11 also includes higher order bits fed to preset counter PC4, and lower order bits representing intermediate value which is fed to preset counter PC5. With the condition described hereinbefore, the interpolation computation starts. In each computation below, control is made by sequence controller 14.

1. First, values in preset counters PC1 and PC4 are fed to the address modifier 15. If the value of PC1 is x1 and that of PC4 is y1, the memory 16 gives a value A as shown in FIG. 11. The value A is applied through data selector D4 to register R4.
2. The content of preset counter PC1 is added by 1 to convert x1 to x2, and the x2 is transferred to the address modifier in order to read value B of FIG. 11 from the memory 16. This value B is applied through data selector D3 to register R3.
3. The sequence controller 14 instructs the null detector ND1 to detect zero indication of the preset counter PC2 in which is stored an intermediate value (x−x1) concerning the engine rotation. At the zero detection, the adder ADD4 adds the content of register R7 (the value at that time, i.e., at the initial point, is zero forced by sequence controller) to the content A of register R4 and stores the result in register R9. It is apparent that the interpolation for engine rotation is unnecessary at that time.
4. If the preset counter PC2 gives a value other than zero, the sequence controller 14 directs the following computation: The subtracter subtracts the content A of register R4 from the content B of register R3, and stores the difference (B−A) in register R5.
5. The adder ADD3 executes an addition of contents of registers R5 and R6 (at this time, or at the beginning of the computation, the content of R6 is zero forced by the controller), and stores the sum (B−A) in register R7. With this adding operation, 1 is substracted from the content of counter PC2 for lower order bits under the control of the sequence controller.
6. The sequence controller 14 instructs the null detector ND1 to detect the zero indication of preset counter PC2. When the zero is detected, the value (B−A) in register R7 is shifted to get one divided by (x2−x1) of the value. In this embodiment, (x2−x1) is assumed to be 16 so that the content of the shift register must be shifted down by the corresponding times.

7. At adder ADD4, the resultant value (1/16) (B−A)×1 is added to the value A to give A+(1/16) (B−A)×1, that is E.
8. If the content of the counter PC2 is 2 or more, and as was mentioned hereinbefore, subtraction of "1" from the content of the counter PC2 does not make "0," the value (B−A) stored in register R7 is again stored in register R6.
9. Adder ADD3 adds the value (B−A) from register R5 to the value (B−A) from the register R6 and the sum (B−A)×2 is stored in register R7. In this second addition, the content (representing lower order bits) of the counter PC2 is again subtracted by 1 under the control of the controller 14. The sequence controller 14 is again informed by the null detector if it detected zero indication of the counter PC2.
10. If the counter PC2 indicates a number other than zero, the content of register R7 is transferred to register R6 and added ADD3 repeats the adding operation until the counter PC2 indicates zero.
11. When the content of the preset counter PC2 reaches zero, the content of the register R7 is shifted down (in this embodiment, (1/16) of the content is produced), and then added to the value A from register R4 at adder ADD4. The sum $$E = A + \frac{1}{(x2 - x1)}(B - A)(x - x1)$$

is stored in register R9.

12. Computation of interpolation value F:

Starting from a condition that preset counters PC1 and PC4 for higher order bits have values x2 and y1 respectively, the counter PC4 adds "1" to the higher-order-bit data to change it from y1 to y2 before applying it to address modifier or converter 15 which addresses the memory M1 to read the output value shown by C of FIG. 11. Said C is fed through data selector D3 to register R3.

13. Preset counter PC1 subtracts 1 from its content x2 so that the value x2 may be counted down to x1 under the control of sequence controller 14. The resultant value x1 is applied to the modifier or converter 15 in order to read out value D of FIG. 11 from memory M1, which is fed through data selector D4 to register R4.
14. After the completion of interpolation computation, the lower order bits representing intermediate value are fed to the counter PC2 now having zero count resulted from previous interpolation computation for value E. In the same manner as the computation of interpolation value E, an interpolation value F is computed by using values C and D. The interpolation value F is stored in register R8. To that end, the register R8 has value F and register R9 has value E.
15. Next, interpolation value G is computed: content F of register R8 is fed through data selector D3 to register R3, and content E of register R9 is fed through data selector D4 to register R4.
16. Using the intermediate value (y−y1) concerning throttle opening angle and stored in preset counter PC5, interpolation value G of FIG. 11 is computed in the same manner as the interpolation value E was computed. The value G is then stored in register R9.
17. The interpolation computation is completed and the value G is transferred from register R9 to subsequent correcting quantity computing unit 18.

Next, correcting quantity computing unit 18 will be explained referring to FIG. 12. The computing unit 18 multiplies the digital output from interpolation computing unit 17 by the correction coefficient number produced in response to the outputs of, such as air pressure, aspirated air temperature and engine temperature sensors. In this embodiment, the unit 18 employs an adder for multiplication. Multiplication by adder is done in such manner that a computation of 3×4, for example, is performed by an addition of four 3s. However, in case of computing 3×0.4, or the computation of a number including a fraction, it is impossible to execute addition 0.4 times. Therefore, if the value 0.4 is an analog expression, it is 10 fold amplified by using an amplifier, but if the value is a digital expression, shifting of the value brings about the 10 fold multiplication, or integer 4, thereby making it possible to execute the addition of 3 four times. In the above mentioned example, the number was multiplied by 10 to move the position of radix point because a decimal number was treated. In the case of a binary number, the multiplier is 2. The reason why the shift of radix point is explained here is that the correction coefficient will possibly be fraction.

In the correcting quantity computing unit of FIG. 12, the analog signals from sensors 10*a*, 10*b* and 10*c* are amplified at corresponding amplifiers, one of them being selected by analog gate AG1, and is fed to A-D converter AD1, where it is digitized.

First, explanation is made on of the case where the output of the air pressure sensor 10*a* is selected by the analog gate. The air pressure sensor compares atmospheric pressure p to a standard pressure $p_o$ and gives the difference. The output can be given in the form of $K(p/p_o)$ by utilizing a proper sensor. The value is digitized at A-D converter AD1 before being fed through data selector D7 to preset counter PC6. The value stored therein is a correction coefficient for the air pressure. The amplifier A1, A-D converter AD1 or preset counter PC6 must execute the shifting of radix point described hereinbefore so that the correction coefficient applied to the preset counter may be an integer. These operations are executed orderly under a control of the sequence controller 14.

Next, the sequence of correcting quantity computation will be explained. In the first, the sequence controller 14 instructs the counter PC6 to subtract 1 from its content. On the other hand, the digital value in the interpolation computing unit 17 is stored through data selector D6 in register R11, and is also directly in register R10.

The controller 14 instructs the null detector ND3 to detect zero count of the preset counter PC6. If the count is zero, the content of register R11 is the value corrected in air pressure. If the content of the counter is not zero, the controller 14 instructs the adder ADD5 to execute addition of the content of register R10 to that of R11, and to transfer the sum to register R11 through latch L4 and data selector D6. At the same time, 1 is subtracted from the content of the counter PC6.

After the downward counting, the content of the counter PC6 is checked for zero detection. If it is zero, the content of the register R11 is the value corrected in air pressure. If it is not yet zero, said addition is carried out and the adding operation is repeated until the counter reaches zero count. Thus, the register R11 finally gets a value multiplied by the correction coefficient. The value, however, has a radix point not shifted. Therefore, it is necessary that the content of register R11 be shifted to move the radix point after air pressure correction is completed or it is moved after all correcting computations are over. Instead of executing these operations there, an integer without radix point movement may be applied to data-time converter 19, where the value is read as a fractional member.

Next, explanation will be made of the case where the analog gate selects the value from the aspirated air temperature sensor. The aspirated air temperature sensor **10*b* gives the temperature of the aspirated air in analog value t. Several methods are known to compute a function $(273+t_o)/(273+t)$ by using the temperature t, but the present embodiment adopts a method to read necessary computed value out of memory M2 according to the temperature of the aspirated air. Where, "$t_o$" stands for the standard temperature. First of all, an output of aspirated air temperature sensor 10*b* is digitized at A-D converter AD1 and then is fed to memory M2 in the correction coefficient computing unit 22, so that proper data is fed through data selector D7 to preset counter PC6**. On the basis of these values, multiplication is carried out in the same manner as for said air pressure correction, executing aspirated air temperature correction.

Next, explanation will be made of the case where the analog gate selects the value from the engine temperature sensor. The engine temperature sensor **10*c* usually gives continuously increasing or decreasing output with increasing temperature, but it may be something like a switch element that gives a graded output. The output of the sensor 10*c* is applied to an amplifier A3** either for amplification or for obtaining a desired nonlinear characteristic. This value is used for the correction in the same manner as that in air pressure correction. It is possible to execute the necessary correction without a special engine temperature sensor if a memory is used as was described in case of aspirated air temperature correction. It is also possible to perform the engine rotation number correction by applying the engine rotation number to an amplifier and changing the gain of the amplifier in response to the requirement of the engine. For example, it is possible to increase the quantity of the fuel injection when the engine is at a low temperature and is idling.

Figure 13:
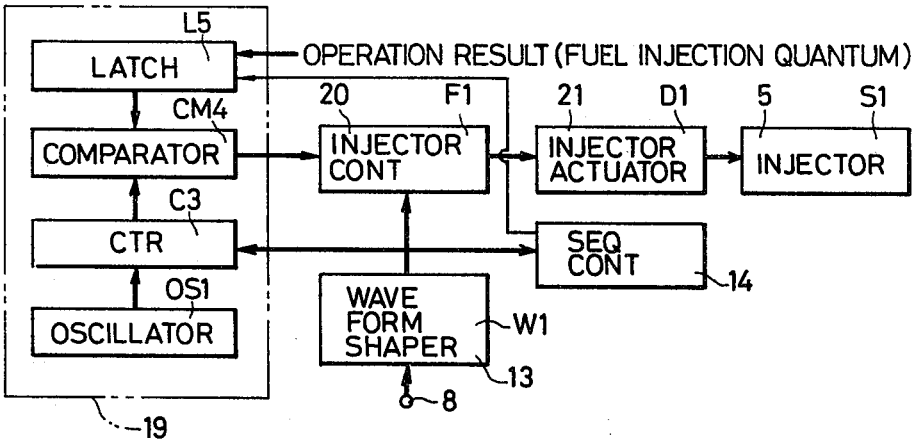
FIG. 13 is a block diagram of the data-time converter.
Figure 14:
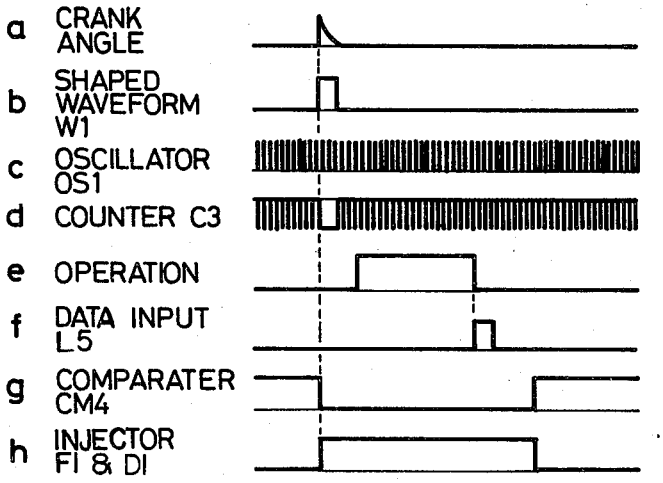
FIG. 14 shows a time chart of the converter shown in FIG. 13.

Data-time converter 19 will be explained referring to FIGS. 13 and 14. The data-time converter 19 includes a central comparator CM4 with a its one input supplied with digital value from the correcting quantity computing unit 18 through latch L5 and other input supplied with a digital value from counter C3 which is connected to an oscillator OS1 oscillating with a constant frequency and counts the output therefrom.

Explanation below includes the operation of fuel injector controller 20, fuel injector actuator 21 and fuel injector 5. The crank angle sensor 8 pulses a demand for starting the action of sequence controller 14 through waveform shaper 13, in order to set the fuel injector controller 20, comprising a flipflop, and to reset and start the counter C3. Then, under the control of controller 14, a digital value from correcting quantity computing unit 18 is set at the latch 15 before it is applied to the comparator CM4.

The fuel injector controller 20 is set to keep sending an enabling signal of the fuel injector 5 to the fuel injector actuator driver 21. During the said period, the actuator 21 keeps the injector or nozzle valve open. The counter C3 counts the output of the oscillator OS1 and gives the count to comparator CM4. This count is always compared with the digital value from the correcting quantity computing unit 18. When the counter C3 counts up to the same or a greater number than that of the unit 18, the comparator CM4 sends a trigger signal to the injector controller 20 to turn it to the reset state. When that occurs, the generation of the signal for actuating the injector 5 stops, and the injector nozzle valve is closed. That means, the fuel injection period is given by an amount of time the counter C3 spent before its content reaches the digital value of the correcting quantity computing unit, or in other words the digital value of the unit 18 is converted to a time interval for the fuel injection.

Figure 15:
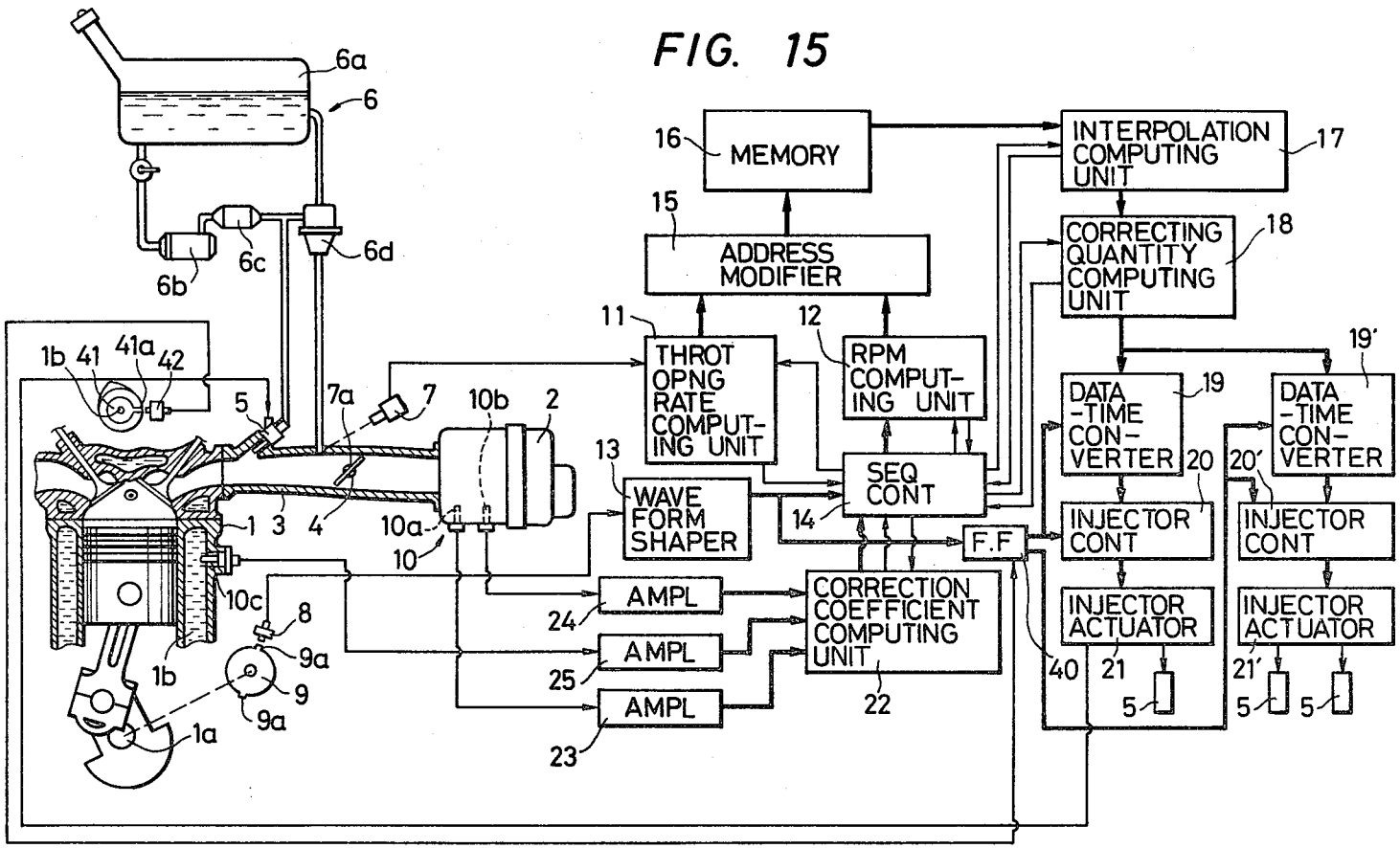
FIG. 15 is a partial block diagram of a second embodiment of this invention.

The above mentioned embodiment concerns a 4-cylinder 4-cycle engine having an air intake manifold 3 equipped with a common injector 5. Where the air intake manifold of each cylinder has its own injector, the system of FIG. 15 is utilized. Namely, (a) In parallel with a series connection of data-time converter 19, injector controller 20 and injector actuator 21, the same connection denoted by 19', 20' and 21' is provided, (b) Each of the injector actuators 21 and 21' is connected with two injectors 5,5. (c) A switching circuit, of a flip-flop circuit 40, is provided between the waveform shaper 13 and the connection lines to the data-time converters 19, 19' and injector controllers 20, 20'. (d) The flip-flop circuit 40 has a control electrode connected to an output terminal of the rotation number sensor facing a projection **41*a* on a rotatable disk 41 mounted on a valve driving cam shaft 1*b*, and serves to allot the output of the waveform shaper 13 to drive each injector 5**.

Figure 16:
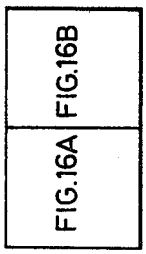
FIG. 16 shows how to arrange FIGS. 16A, 16B.
Figure 17:
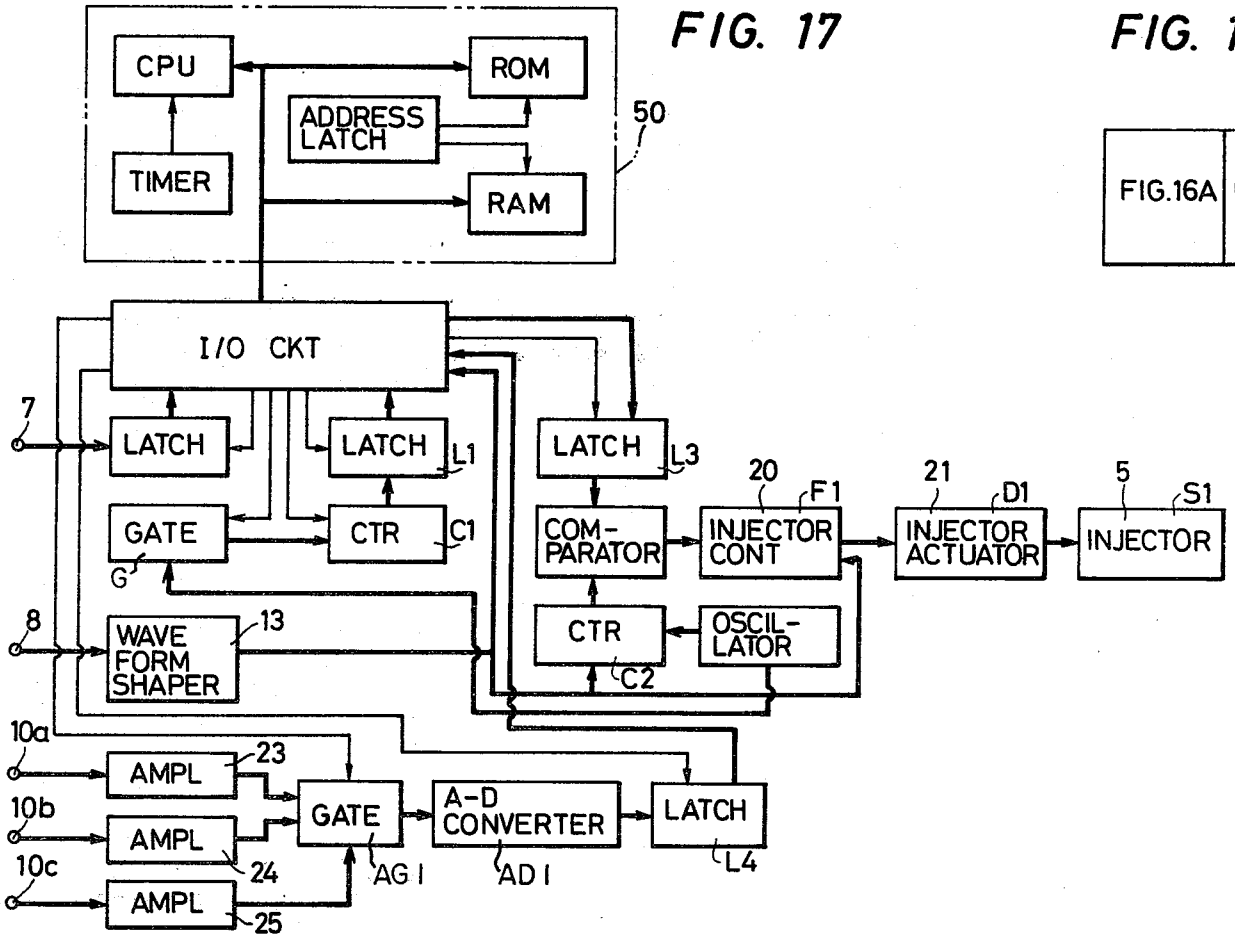
FIG. 17 is a block diagram illustrating the system of the first embodiment partly replaced by a micro-computer.
Figure 16A:
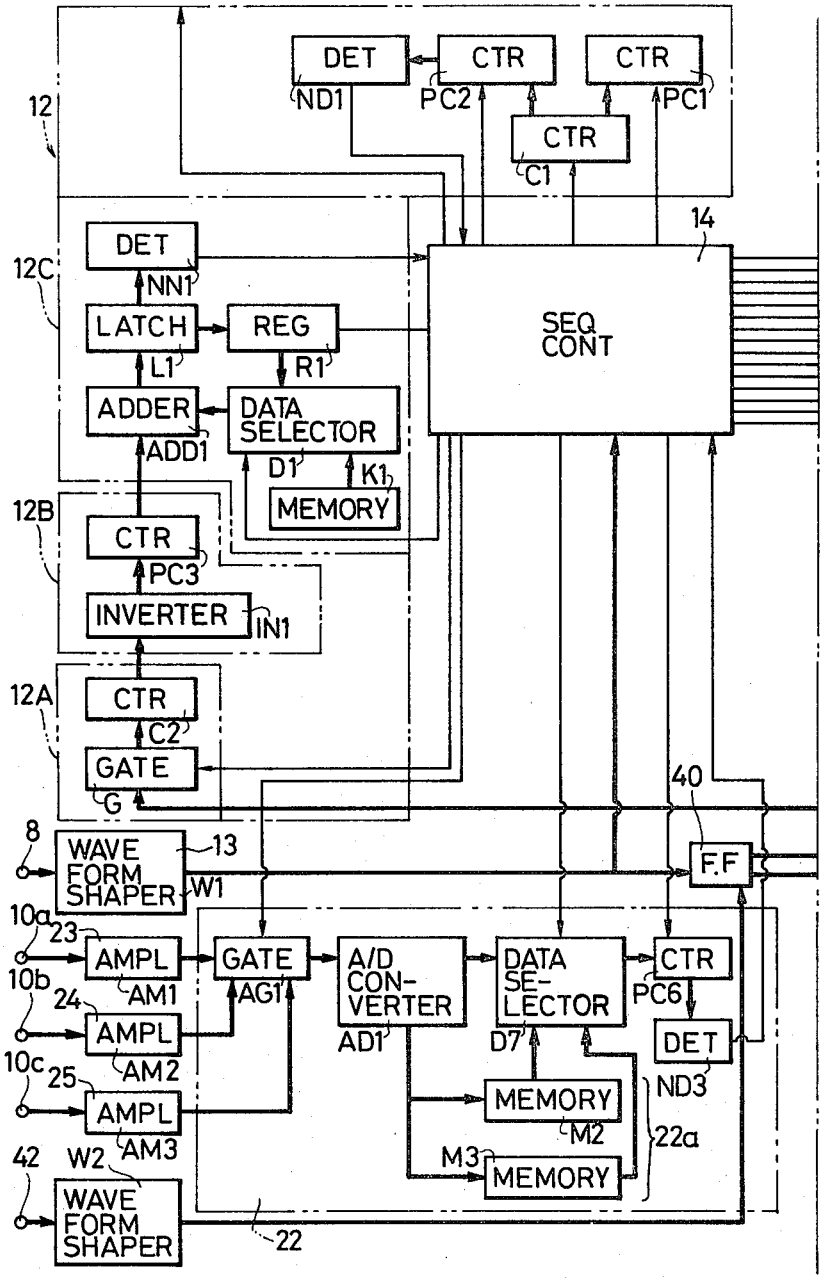
FIGS. 16A and 16B together constitute a block diagram illustrating a part of the second embodiment.
Figure 16B:
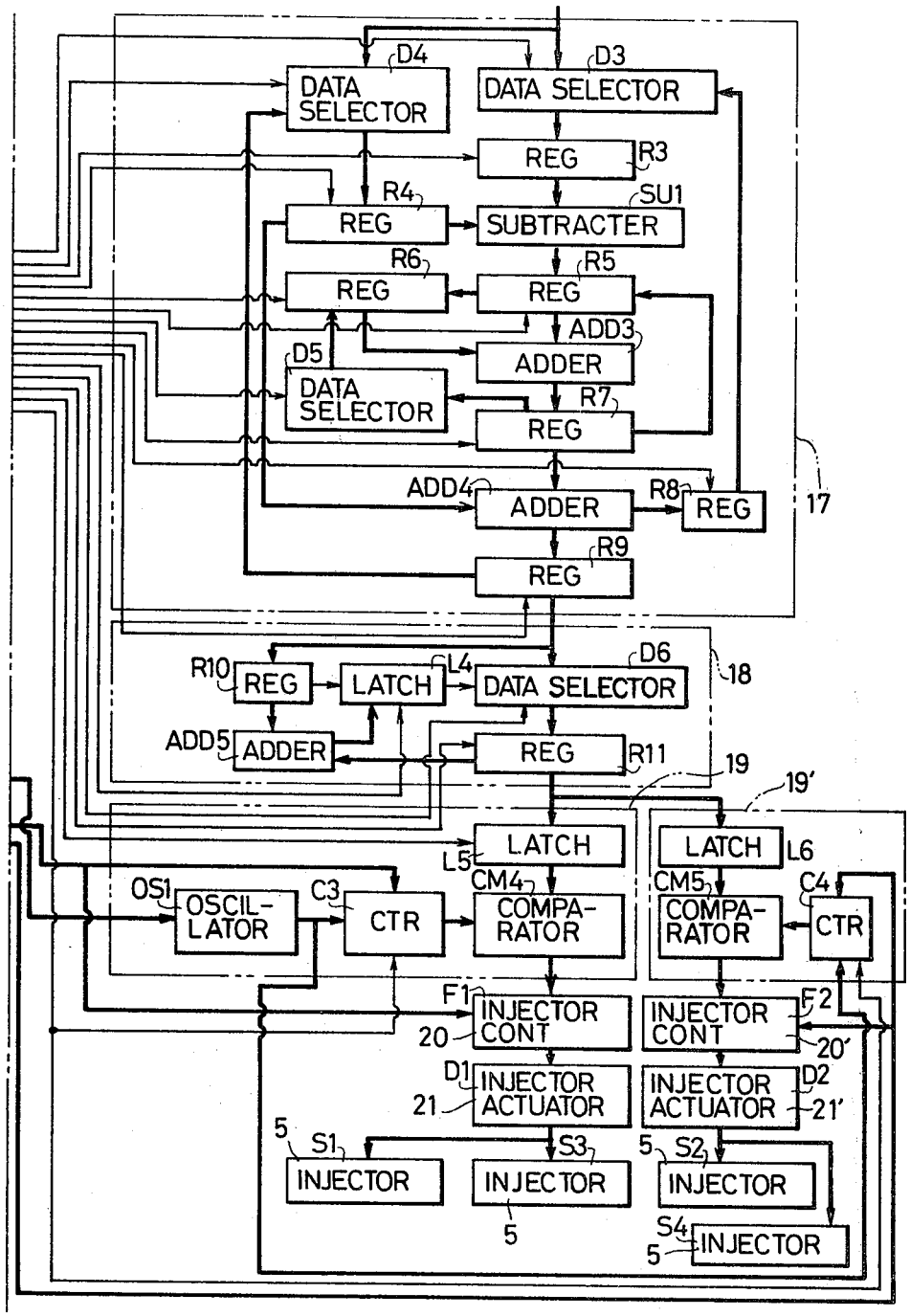

A block diagram of these parts is shown in FIGS. 16A and 16B. FIG. 16 shows how to arrange these FIGS. 16A and 16B. A part of the circuit configuration may be replaced by a micro computer 50 as shown in FIG. 17. In the example of this figure, it will be easy to understand that the engine rotation number computing unit, address converter, memory, interpolation computing unit, correcting quantity computing unit, a part of correction coefficient computing unit and sequence controller are replaced by miro computer. It is apparent that two or more of the adders, registers, preset counters, latches, data selectors etc. can be shared if their service time are different.

Figure 18:
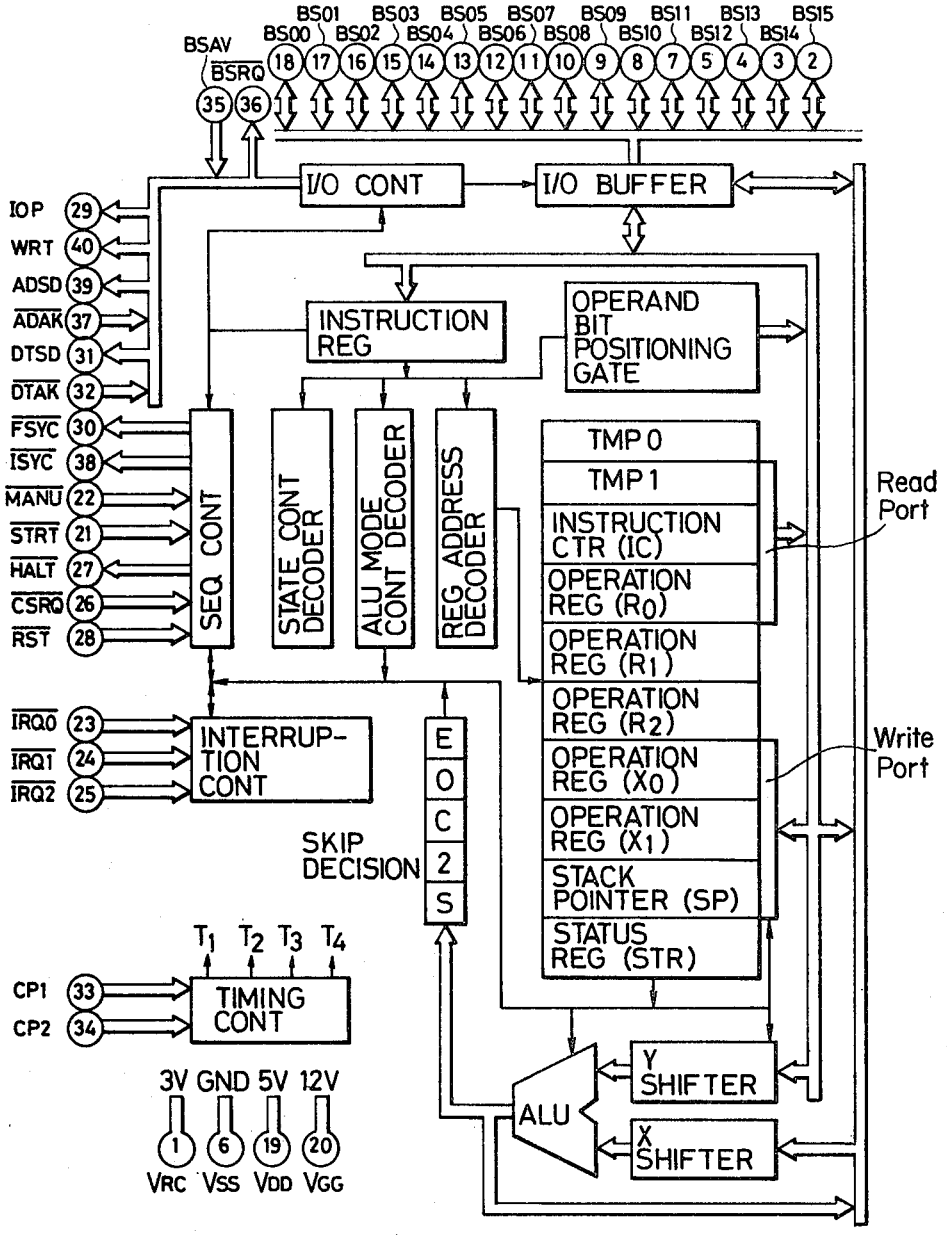
FIG. 18 is a block diagram of the said micro-computer.
Figure 19:
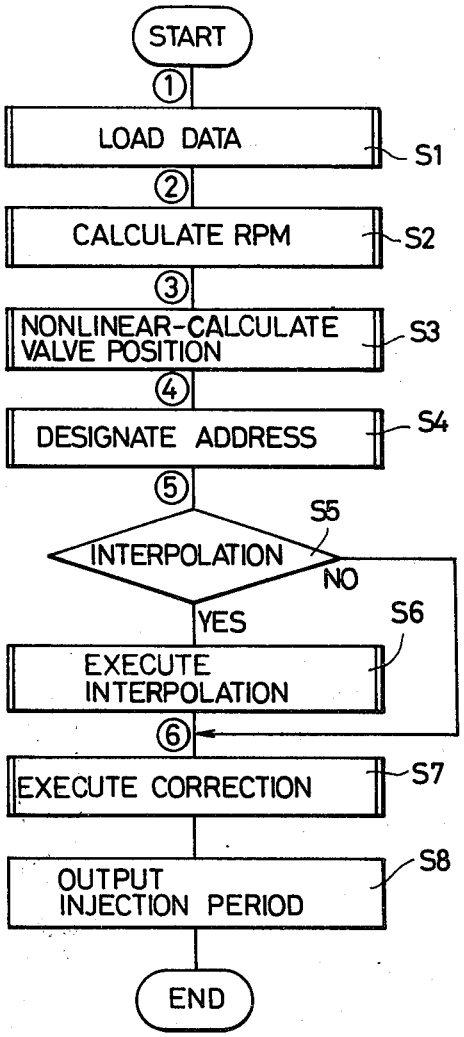
FIG. 19 is a flow chart for explanation of operation of the system employing the micro-computer.
Figure 19A:
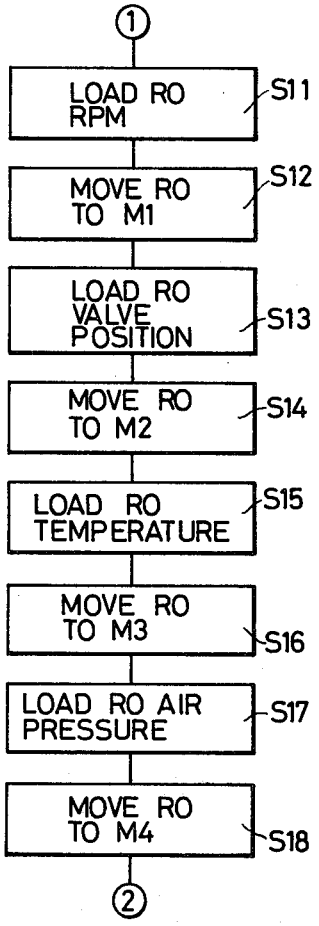
FIGS. 19A to 19F are flow charts of the subroutines.
Figure 19B:
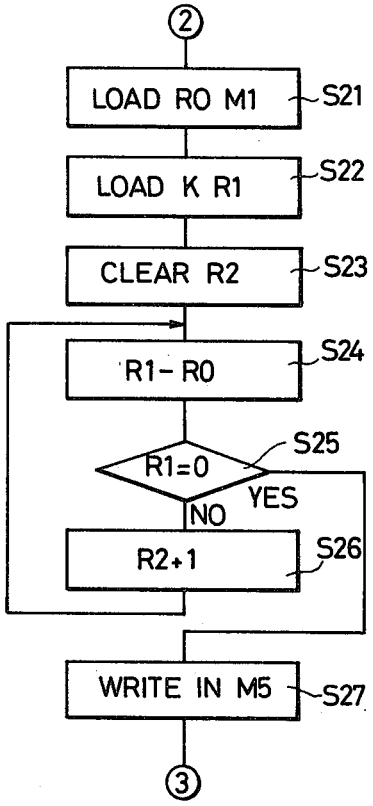
Figure 19C:
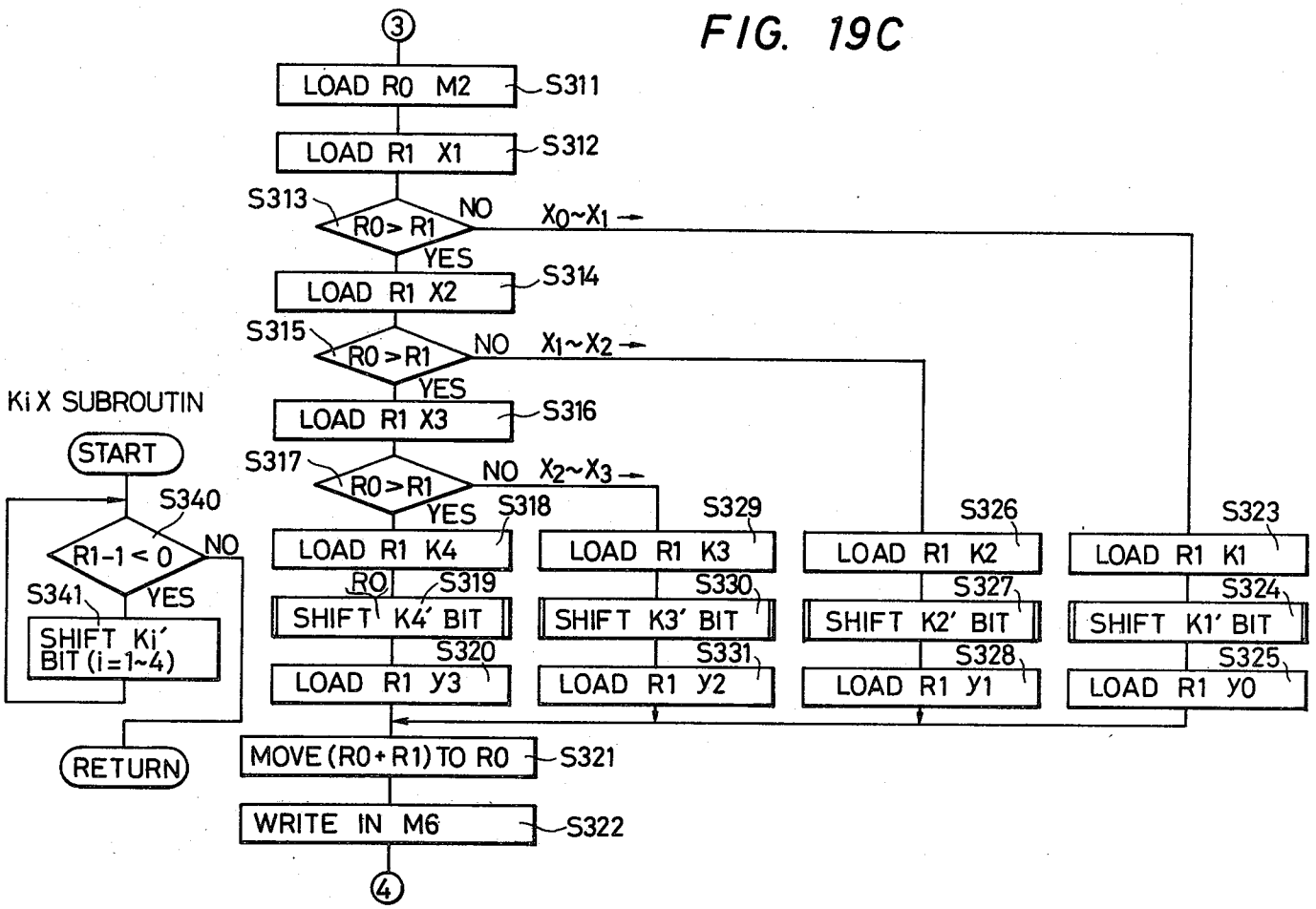
Figure 19D:
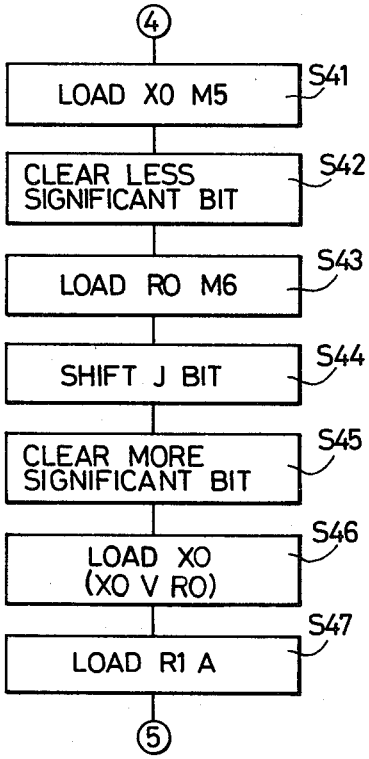
Figure 19F:
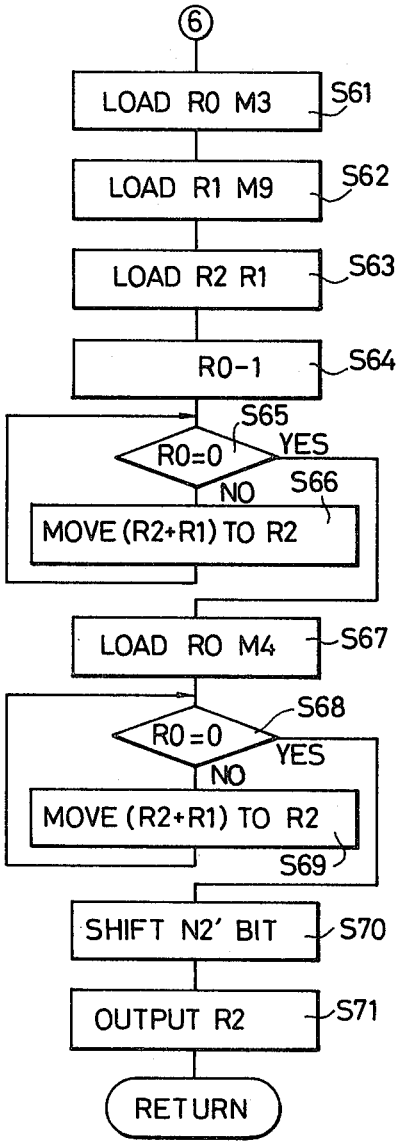
Figure 19E:
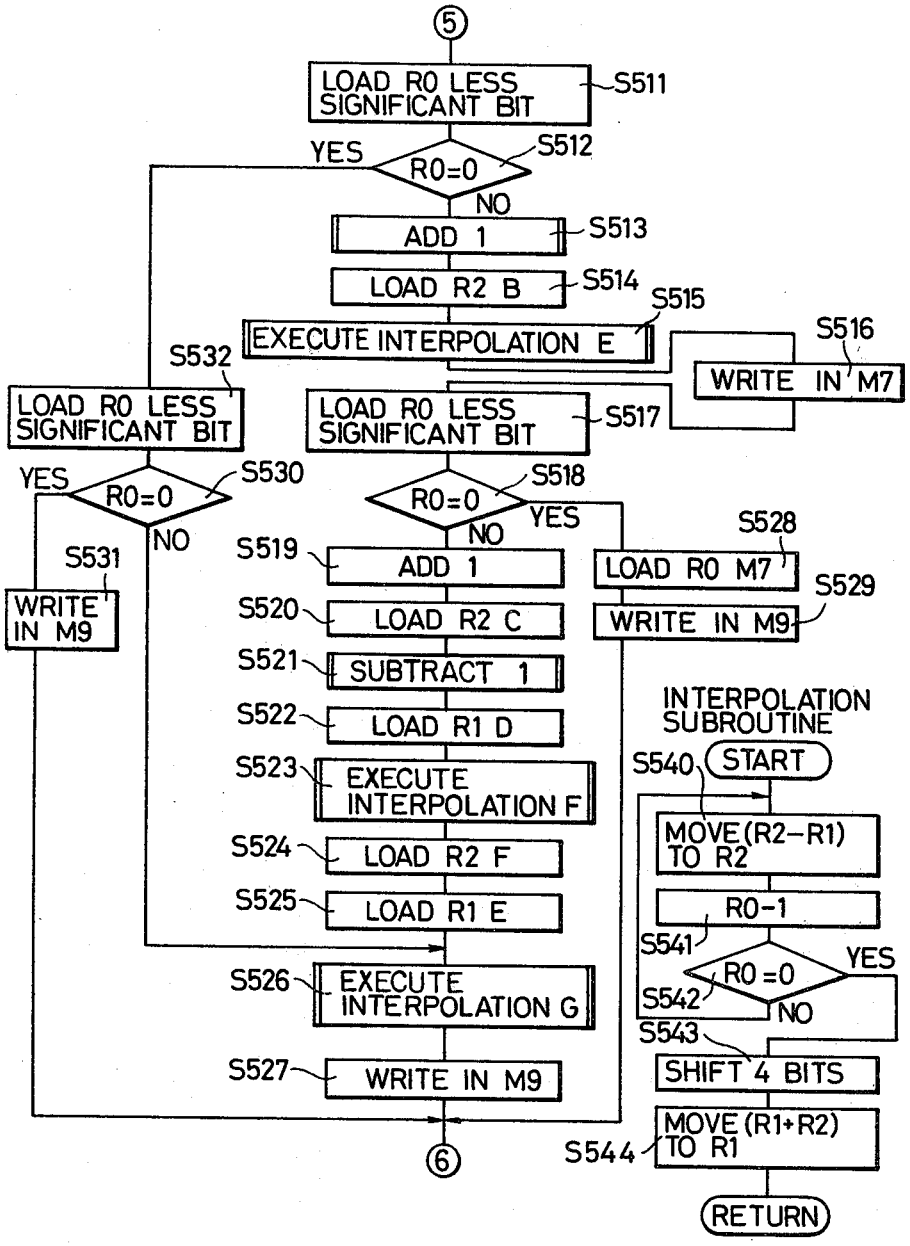

FIG. 18 shows the computer CPU part of the circuit of FIG. 17. FIG. 19 is a flow chart of the operation and FIGS. 19A to 19F are flow charts of the sub-routine in FIG. 19. The following table tabulates an area allotment on RAM of FIG. 17 when the computation is performed with the dots-and-dash line of FIG. 6.

| Area Allotment | |
|---|---|
| M1: counter C data | |
| M2: throttle opening angle data | |
| M3: temperature data | M22: constant x2 (FIG. 6) |

-continued

| Area Allotment | |
|---|---|
| M4: air pressure data | M23: constant x3 (FIG. 6) |
| M5: computed engine data | M24: constant k1 (FIG. 6) |
| M6: computed throttle data | M25: constant k2 (FIG. 6) |
| M7: interpolation E | M26: constant k3 (FIG. 6) |
| M8: interpolation F | M27: constant k4 (FIG. 6) |
| M9: interpolation G | M28: constant y0 (Y'H in range of x0 ~ x1) |
| | M29: constant y1 (Y'H in range of x1 ~ x2) |
| | M30: constant y2 (Y'H in range of x2 ~ x3) |
| | M31: constant y3 (Y'H in range of x3 ~ x4) |

Where it is easily recognized that there are the following relations between the contents of Memory M14~M21 and M24~M31.

| |
|---|
| Content of M14 = content of M28 |
| Content of M15 = content of M29 |
| Content of M16 = content of M30 |
| Content of M17 = content of M31 |
| Content of M18 = content of M24 |
| Content of M19 = content of M25 |
| Content of M20 = content of M26 |
| Content of M21 = content of M27 |

Next, operation steps of each flow chart will be explained below:

step-S1: Read data representing engine rotation, throttle opening angle, temperature and air pressure.
step-S2: Compute the engine rotation number
step-S3: Execute non-linear operation of the throttle opening angle
step-S4: Decide the address on the first memory based on the engine rotation number and the throttle opening angle
step-S5: Judge if it is necessary to compute the interpolation
step-S6: Execute the sub-routine for interpolation computation
step-S7: Execute the sub-routine for correcting quantity computation
step-S8: Output fuel injection period
step-S11: Write the engine rotation data into register R0
step-S12: Move content of register R0 to memory M1
step-S13: Write the throttle opening angle data into register R0
step-S14: Move content of register R0 to memory M2
step-S15: Write the temperature data into register R0
step-S16: Move content of register R0 to memory M3
step-S17: Write the air pressure data into register R0
step-S18: Move content of register R0 to memory M4
step-S21: Transfer data from memory M1 to register R0
step-S22: Transfer constant K from memory M20 to register R1
step-S23: Clear register R2
step-S24: Subtract content of register R0 from content of register R1
step-S25: Judge if content of register R1 is zero
step-S26: Add +1 to content of register R2
step-S27: Write data of register R2 in memory M5
step-S311: Transfer data from memory M2 to register R0
step-S312: Transfer constant x1 from memory M32 to register R1
step-S313: Judge if R0>R1
step-S314: Transfer constant x2 from memory M22 to register R1
step-S315: Judge if R0>R1
step-S316: Transfer constant x3 from memory M23 to register R1
step-S317: Judge if R0>R1
step-S318: Transfer constant K4 from memory M27 to register R1
step-S319: Shift content of register R0 by K4' bits
step-S320: Transfer constant y3 from memory M31 to register R1
step-S321: Add content of register R0 to that of register R1 and store the sum in register R0
step-S322: Move data from register R0 to memory M6
step-S323: Transfer constant K1 from memory M24 to register R1
step-S324: Shift content of register R0 by K1' bits
step-S325: Transfer constant y0 from memory M28 to register R1
step-S326: Transfer constant K2 from memory M25 to register R1
step-S327: Shift content of register R0 by K2' bits
step-S328: Transfer constant y1 from memory M29 to register R1
step-S329 Transfer constant K3 from memory M26 to register R1
step-S330: Shift content of register R0 by K3 bits
step-S331: Transfer constant y2 from memory M30 to register R1
step-S340: Judge if the quotient resulting from subtraction of 1 from content of register R1 is zero or not
step-S341: Shift content of register R0 by Ki(i=1-4) bits
step-S41: Transfer data from memory M5 to register X0
step-S42: Clear lower order bits in register X0
step-S43: Transfer data from memory M6 to register R0
step-S44: Shift content of register R0 by J bits to right
step-S45: Clear higher order bits in register R0
step-S46: Transfer logic OR of register X0 and R0 to register X0
step-S47: Address memory area by using content of register X0, and transfer data A (FIG. 11) at the address to register R1
step-S511: Read data from memory M5, and transfer the lower order bits thereof to register R0
step-S512: Judge if content of register R0 is zero
step-S513: Add 1 to higher order bits in register X0
step-S514: Address memory area by using content of register X0, and transfer data B (FIG. 11) at the address to register R2
step-S515: Execute interpolation computation for E (FIG. 11) and move E to register R1
step-S516: Write data E of the register R1 into memory M7
step-S517: Move lower order bits of the data read out of memory M6 to register R0
step-S518: Judge if register R0 has zero indication
step-S519: Add 1 to lower order bits in register X0 step-S520: Address memory by using content of register X0, and move the data C (FIG. 11) therefrom to register R2
step-S521: Subtract 1 from higher order bits of the data in register X0
step-S522: Address memory by using content of register X0, and move the data D (FIG. 11) therefrom to register R1
step-S523: Execute interpolation computation for F (FIG. 11) and move F to register R1
step-S524: Transfer data F in register R1 to register R2
step-S525: Transfer data E from memory M7 to register R1
step-S526: Execute interpolation computation for G (FIG. 11) and move G to register R1
step-S527: Write content G of register R1 into memory M9
step-S528: Transfer content E of memory M7 to register R0
step-S529: Write content of register R0 into memory M9
step-S530: Judge if the content of register R0 is zero
step-S531: Write data in register R0 into memory M9
step-S532: Transfer lower order bits read out of memory M6 to register R0
step-S540: Subtract content of register R1 from content of register R2, and let register R2 memorize the result temporarily
step-S541: Subtract 1 from content of register R0
step-S542: Judge if the content of register R0 is zero
step-S543: Shift content of register R2 by 4 bits to left
step-S544: Add content of register R1 to content of register R2, and let register R1 memorize the result temporarily
step-S61: Transfer data read from memory M3 to register R0
step-S62: Transfer data read out of memory M9 to register R1
step-S63: Transfer data from register R1 to register R2
step-S64: Subtract 1 from content of register R0
step-S65: Judge if the content of register R0 is zero
step-S66: Add content of register R2 to content of register R1, and move the sum to register R2
step-S67: Transfer data from memory M4 to register R0
step-S68: Judge if the content of register R0 is zero
step-S69: Add content of register R2 to content of register R1, and move the sum to register R2
step-S70: Shift content of register R2 by N2 bits
step-S71: Output content of register R2

Thus, according to the present invention, the engine has at least a first and a second sensor for detecting the value associated with the aspirated air volume. The detected values are applied through an address converter to a first memory from which a digital form of fuel injection quantity or period data corresponding to the aspirated air volume is read out. The engine also has a third sensor that gives a digital value. The output of the third sensor itself or the digital value read out of a second memory driven by the output is multiplied by the digital value read from said first memory. As the digital value corrected by the multiplication is used to control the fuel injection quantity or period, correct control of the fuel quantity to be supplied to the engine is carried out depending upon the volume of aspirated air and its condition, that is mass of aspirated air. Since the first memory driven by detected outputs of the first and second sensors are used to take out a digital value depending upon the aspirated air volume, there is no need to use a large computer that can treat higher order functions. Moreover, as the digital value concerning the aspirated air volume is corrected in accordance with the condition of the aspirated air, the engine control is more accurate than the control by the signal associated only with the volume of the aspirated air. In addition, it has such advantage that each memory can be made smaller in capacity than the one addressed by such parameters as the aspirated air volume and its condition.

What we claim is:

1. An engine controlling system comprising:
a plurality of sensors for detecting the engine operating conditions,
a memory storing the digital values of predetermined fuel injection quantities depending upon two parameters which are derived from the outputs of two of said sensors and represent throttle valve position and engine rpm at storage locations that are addressed by said two parameters,
means responsive to said parameters for addressing said memory to read out of said memory the digital fuel injection quantity based on said two parameters,
means for obtaining corrected fuel injection quantity from said read-out fuel injection quantity multiplied by a coefficient associated with at least one further parameter detected by said sensors, and
means for controlling the engine by using the corrected controlling quantity, the predetermined fuel injection quantities being stored in said memory with small variations within the range of engine operation corresponding to small values of throttle opening, but being stored in said memory with significantly greater variations in that range of operations where there are larger values of throttle opening.

2. An engine controlling system according to claim 1, wherein the higher order bit signals of the two parameters used for addressing said memory are used to read out the predetermined fuel injection quantity from said memory, and the lower order bit signals of said two parameters are used to interpolate the fuel injection quantity read out from said memory.

3. An engine controlling system according to claim 1, wherein the entire variation range of one of the parameters used to address the memory is divided into a plurality of regions and the predetermined fuel injection quantity stored in said memory is stored with variations of fixed value of said parameter in the respective regions.

4. An engine fuel supply controlling system according to claim 1, wherein said further parameter is air pressure.

5. An engine fuel supply controlling system according to claim 1, wherein said further parameter is engine temperature.

6. An engine fuel supply controlling system according to claim 1, wherein said further parameter is aspirated air temperature.

* * * * *